US007299527B1

(12) United States Patent
Gyure

(10) Patent No.: US 7,299,527 B1
(45) Date of Patent: Nov. 27, 2007

(54) STRAP RETAINER DEVICE

(76) Inventor: Gerald Albert Gyure, 12146 W. Belleview Dr., Littleton, CO (US) 80127

( * ) Notice: Subject to any disclaimer, the term of this patent is extended or adjusted under 35 U.S.C. 154(b) by 0 days.

(21) Appl. No.: 11/424,843

(22) Filed: Jun. 16, 2006

(51) Int. Cl.
*A44B 11/04* (2006.01)

(52) U.S. Cl. ..... 24/198; 24/200; 24/570; 24/265 AL; 297/250.1; 297/484

(58) Field of Classification Search ..... None
See application file for complete search history.

(56) References Cited

U.S. PATENT DOCUMENTS

| | | | | | |
|---|---|---|---|---|---|
| 343,824 | A | * | 6/1886 | Lowe | 24/571 |
| 958,249 | A | * | 5/1910 | Hirsh | 24/199 |
| 1,755,291 | A | | 4/1930 | Fox | |
| 1,814,978 | A | * | 7/1931 | Swanson | 24/19 |
| 1,860,170 | A | | 5/1932 | Bronson | |
| 2,040,958 | A | | 5/1936 | Schottenfels | |
| 2,140,164 | A | | 12/1938 | Moffatt | |
| 2,212,862 | A | | 8/1940 | Hirsh | |
| 2,233,397 | A | | 3/1941 | Bloom | |
| 2,278,153 | A | | 3/1942 | Shaulson | |
| 2,595,139 | A | | 4/1952 | Hart | |
| 2,901,801 | A | | 9/1959 | Girodet | |
| 3,037,257 | A | | 6/1962 | Girodet | |
| 3,121,270 | A | | 2/1964 | Van Den Broek et al. | |
| 3,161,931 | A | | 12/1964 | Zif | |
| 3,218,686 | A | * | 11/1965 | Rubenstein | 24/198 |
| 3,408,708 | A | * | 11/1968 | Hawie | 24/478 |
| 3,529,329 | A | | 9/1970 | Burleson | |
| 3,663,995 | A | | 5/1972 | Somann | |
| 3,929,351 | A | * | 12/1975 | Fricko | 297/475 |
| 4,315,350 | A | | 2/1982 | Looker et al. | |
| 4,457,051 | A | | 7/1984 | Bartolini | |
| 4,484,379 | A | | 11/1984 | Appelt et al. | |
| 4,540,218 | A | * | 9/1985 | Thomas | 297/467 |
| D285,383 | S | | 9/1986 | Anthony | |
| 4,642,853 | A | | 2/1987 | Plesniarski et al. | |
| 4,862,563 | A | | 9/1989 | Flynn | |
| 4,941,434 | A | | 7/1990 | Ellwanger | |
| 5,177,837 | A | | 1/1993 | Rekue | |
| 5,326,202 | A | | 7/1994 | Stubbs | |
| D356,658 | S | * | 3/1995 | Bernart | D2/624 |

(Continued)

FOREIGN PATENT DOCUMENTS

| | | |
|---|---|---|
| FR | 661885 | 7/1929 |

*Primary Examiner*—Jack W. Lavinder
(74) *Attorney, Agent, or Firm*—Roger A. Jackson

(57) ABSTRACT

A strap retainer device and method for retaining a first object to a second object, the device including a body that is generally planar with an outer periphery portion, the body including a first end portion and a substantially oppositely disposed second end portion. The first end portion is adapted to attach to the first object and the second end portion includes a slot therethrough that is closed at both ends, the second end portion also includes a tortuous passageway therethrough that extends from the outer periphery portion to be in communication with the slot. The tortuous access passageway is operational to allow the strap to be selectably manually positioned from the outer periphery portion to the slot and selectably manually positioned from the slot to the outer periphery portion, wherein the tortuous access passageway helps restrict the strap from inadvertently dislodging from the slot to the outer periphery portion.

5 Claims, 24 Drawing Sheets

U.S. PATENT DOCUMENTS 5,432,985 A * 7/1995 Bernart ..... 24/265 AL
5,438,734 A 8/1995 Anderson
5,625,925 A 5/1997 Richards
5,784,763 A 7/1998 Cassidy
5,848,454 A 12/1998 Kojoma
6,435,940 B1 8/2002 Fildan et al.
6,637,077 B2 10/2003 Doty
6,916,066 B2 * 7/2005 Sedlack ..... 297/250.1

* cited by examiner

STRAP RETAINER DEVICE

TECHNICAL FIELD

The present invention relates generally to a device, which is employed to prevent cargo or an item, which is being transported, from undesired shifting during transit or keeping the item from moving to an undesired or unsafe location. More specifically, the present invention relates to the field of cargo transport in a transport medium that has an open cargo area, wherein the undesired or unsafe shifting of cargo during transit can cause damage to the cargo or create a hazardous situation for the cargo vehicle or other vehicles on the road. In addition, the present invention relates to controlling the position of an item in transit thereby keeping the item from assuming an undesired or unsafe position or location. In particular, the present invention concerns the retaining of cargo in a transportation medium such as a pickup truck bed to prevent the undesired or unsafe shifting of the cargo or item transported therein, thus helping to prevent damage to the cargo or item and helping to prevent a hazardous situation for the cargo vehicle or other vehicles on the road.

BACKGROUND OF INVENTION

Industrialized countries rely upon transportation systems such as over the road trucks, trains, airplanes, and boats for distribution and transportation of both large objects and balky commodities. It is important to the safety of the transportation vehicle, whether it be a truck, car, boat, or train, and to the safety of the cargo that is transported, that the cargo is stabilized while being transported. If the cargo shifts or moves during transport, the cargo can be damaged, ejected, or lost, in addition, the inside of the cargo container can also be damaged. Further, if the cargo is not sufficiently stabilized to avoid shifting, the cargo can potentially unbalance the vehicle and create a dangerous situation. For example, if a vehicle is loaded so that the cargo is distributed evenly in the cargo area of the vehicle and the cargo shifts its location dramatically while the vehicle is traveling, for instance during the negotiation of a curve on the road, the shifting cargo can potentially upset the vehicles center of gravity to such an extent to possibly cause the driver of the vehicle to lose control of the vehicle.

To avoid cargo shifting, cargos are packed as carefully as possible in the container to eliminate any open spaces within the container to minimize the possibility of a cargo shifting. In many circumstances, however, depending upon the specific type of cargo or the nature and size or bulk of the cargo, necessarily result in open spaces between the cargo items within the cargo container, especially in the case of the cargo container being partially filled with cargo which is a quite common occurrence. This is especially true where the cargo is heavy, or of such a unique shape such as a piece of cargo that is very long and narrow, that the cargo container may be at best a compromise to contain the cargo and retain it securely, thus of necessity requiring an open (not having sidewalls or a roof) transportation platform or medium such as a flat bed truck, or flat bed rail car, or flat bed trailer. In order to secure the open regions of the cargo container, it is desirable to provide some sort of restraint device between the cargo and the walls of the cargo bed. These types of cargo retention devices need to be constructed to withstand the shifting forces typically encountered during transport of the cargo. Likewise, they must also be relatively lightweight and preferably capable of adapting any number of size differences that exist between the various cargo containers and cargo shapes. It is also desired that the cargo retention device is easily portable and movable and readily securable/unsecurable within the cargo container space thus allowing the cargo retention device to be easily installed or removed from the cargo containing area.

Focusing specifically on light duty trucks and/or trailers and their respective cargo containing areas the aforementioned problem has been well recognized in the proper art. Furthermore, in retaining cargo or the item by utilizing a flexible strap (with the strap usually having flexibility parallel to its lengthwise axis and reduced flexibility transverse to its lengthwise axis) wherein the strap forms an attachment between the transporting medium and the cargo or item to help prevent the undesirable movement of the cargo or item. As the strap usually has two open or free ends, there is of necessity a strap retainer device required that is adapted to attach to one of the open ends, wherein the other strap open end is substantially selectively fixedly adjustable along the lengthwise axis of the strap or the strap can be tensioned or "cinched" around the cargo or item by manually applying a force along the strap lengthwise axis away from the cargo or item. Thus, the focus of the prior art review is on the strap retainer device, specifically its attachment to the strap and structure to selectively fixedly retain the strap along the lengthwise axis of the strap.

Starting with U.S. Design Pat. No. 356,658 to Bernart and in U.S. Pat. No. 5,432,985 also to Bernart disclosed is a seat belt splitter plate (specifically referring to FIGS. 2 and 6 for the design patent and FIGS. 1 and 2 for the utility patent) that is basically a strap slot with a removal slot positioned at about ⅓ of the lateral distance through the slot. However, the strap, if bunched up in the corner of the slot, could slip out with force in one direction as the removal slot does not require a tortuous path for the strap to exit the plate, such that a tortuous path would at least require an additional ninety (90) degree bend in an opposing direction for the strap to exit the plate, thus helping to prevent the strap exiting the plate if the strap is bunched up in one corner of the slot with force in one direction, meaning in the direction of the removal slot. Thus in Bernart '985 in referring to FIG. 2, it appears that tension of the strap away from the plate is required to prevent removal of the strap from the plate. Similarly, in U.S. Pat. No. 2,212,862 to Hirsh disclosed is a buckle, again like Bernart for the slot removal access not having a tortuous path, except that the single direction removal slot is positioned closer to one end of the long lateral slot, see FIG. 9 in particular. Also, in U.S. Pat. No. 3,929,351 to Fricko disclosed is a comfort clip for a vehicle shoulder belt wherein the clip is retained on the belt at a selected lengthwise position on the belt to prevent the shoulder belt retractor from excessively tensioning the shoulder belt across the user's upper torso. The clip on Fricko is secured to the belt by having a slot configuration similar to Bernart and Hirsh, wherein Fricko is designed to strictly hold the clip at a particular position along the belt length, reference in particular FIG. 4.

Further, in U.S. Pat. No. 2,140,164 to Moffatt disclosed is a hook coupling that has two open slots that are interconnected forming a somewhat "S" shape for clothing apparel use on bra straps and the like. Moffatt has the difference of sliding the strap into place for each open slot, wherein one slot has an angled non tortuous passage at a lateral midpoint resulting in more retention of the strap and the other slot has a restricted open end facilitating quick and easy installation and removal of the strap. Further, continuing in U.S. Design Pat. No. 350,712 to D'Ambrosio et al., disclosed is a clasp with a conventional slot at one end and an open slot in an opposing end that is slightly offset and restricted in width. Finally, in U.S. Design Pat. No. 285,383 to Anthony, disclosed is a seatbelt "T" bar bracket that includes a conventional closed slot, and two open slots, wherein the access to the outer periphery requires the seatbelt strap to make a single right angle bend near one end of the open slot.

Notably, in Bernart, Hirsh, Fricko, Moffatt, D'Ambrosio et al., and Anthony the installation/removal slot transition to the long lateral slot has minimal bends, having a non tortuous path so as to not damage the strap and provide for easy and smooth installation and removal of the strap from the long lateral slot, however, with the compromise being that the strap is only moderately retained in the slot with the strap being easily removed from the slot with the addition of force on the strap being in only one direction different from the slot lengthwise axis or force on the strap transverse to the slot lengthwise axis against the slot side opposite of the removal slot.

Moving to a more conventional strap retainer in U.S. Pat. No. 6,637,077B2 to Doty, disclosed is an adjustable strap, being similar to a conventional motorcycle tie down strap except for a dual attachment system at each end of the strap, having what is known as a "soft hook" and a closed biased member (similar to a mountaineering carabiner) "S" type hook, both of which can provide a non inadvertently detachable attachment system when the tension of the strap is momentarily removed, (although FIG. 7 does not teach a secure way to attach the "soft hook" using a conventional open ended "S" hook). Similarly, in U.S. Pat. No. 5,177,837 to Rekuc, disclosed is a strap attachment buckle having a closed end slot in combination with a open slot that has access from the open slot to the outer periphery portion of the buckle, however, with the addition of a selectably operable gate that is biased to close the open slot, somewhat again like a mountaineering carabiner, i.e. positively retaining a strap in the open slot, except for a remote mechanical linkage to open and close the gate.

Further, in looking at another type of strap or "ribbon" (as more likely defined in the garment industry) retainer in U.S. Pat. No. 4,457,051 To Bartolini, disclosed is a slider for ribbons used for articles of clothing wherein straps (called ribbons) are required for a bra or girdle for instance with Bartolini facilitating a more automated system of ultrasonically welding the ribbon to one end of the slider and using the opposing end of the slider for the strap adjustment. Thus, Bartolini essentially teaches a slot that is merely narrowed at one end, wherein the only resistance to the strap exiting the retainer is the thickness of the strap and/or the flexibility of the retainer by not having a tortuous removal path for the strap from the retainer. Similarly, in U.S. Pat. No. 4,941,434 to Ellwanger, disclosed is a quick connect retaining leash device that has a plurality of open slots that have somewhat restricted openings to the device outer periphery from the open slot for serpentine routing of the leash, wherein an opposing end of the device is adapted to attach to a conventional car seatbelt receptacle, wherein the strap retention in the leash device would be difficult without the serpentine routing of the leash. Also, in looking at U.S. Pat. No. 3,121,270 to Van Den Broek et al., disclosed is a fastening apparatus for anchoring the ends of flexible tape for use in package bundling, wherein the fastening apparatus allows for tensioning and securing the two free ends of the tape without the need for a special tool. Van Den Broek et al. requires the use of two sandwiching elements that frictionally clamp the tape when tension is applied between the tape ends to prevent the tape from sliding out of the slot, as in Bartolini and Ellwanger the slot end only has a width restriction which alone would not be sufficient to substantially retain the strap in the slot.

What is needed is a strap retainer device that is simple and effective in design by not having any moving parts to wear or need adjustment or replacement and to be able to retain the strap in the strap retainer device under a number of conditions. Firstly, allowing for not having to substantially retain the strap at a selectable lengthwise position on the strap, secondly, by helping to allow the strap and strap retainer device to "cinch" up on the cargo and/or item that the strap loops around when tensile force is applied to the strap in an axis substantially parallel to the lengthwise axis of the strap i.e. so that the strap tends to tighten up around the cargo and/or item thereby helping to secure the cargo and/or item when the aforementioned tensile force is applied. Thirdly, that the strap will remain substantially retained in the strap retainer device when the strap is under lengthwise tension (as previously mentioned), and also when the strap is under no lengthwise tension, i.e. even slackened and/or in combination with a force on the strap that is transverse to the strap lengthwise axis and/or in combination with a force on the strap at any angle when the strap is slackened, in other words the strap will remain substantially retained in the strap retainer device under any set or combination of strap conditions being, tight, slackened, side force, and the like, thus helping to prevent the strap from inadvertently dislodging from the strap retainer device that would result in the cargo or item not being held in the desired location causing damage or loss of the cargo or item and helping to prevent a hazardous situation for the cargo vehicle or other vehicles on the road. This is as opposed to most of the previously described prior art strap or ribbon retainers that require tension of the strap or ribbon away from the retainer to keep the strap or ribbon properly positioned within the retainer, i.e. keeping the strap or ribbon from undesirably dislodging from the retainer.

SUMMARY OF INVENTION

According to broadly defining the present invention, then, a strap retainer device for retaining a first object to a second object, the second object being a flexible strap, the device including a body that is generally planar with an outer periphery portion, the body including a first end portion and a substantially oppositely disposed second end portion, the body also having a longitudinal axis spanning between and through the first end portion and the second end portion. Wherein the first end portion is adapted to attach to the first object. The said second end portion includes a second end slot therethrough, the second end slot having a closed proximal end and a closed distal end, the second end portion also includes a second end tortuous access passageway therethrough that extends from the outer periphery portion to be in communication with the second end slot. The second end tortuous passageway is defined by a second end first acute angle and a second end second acute angle, wherein the second end first acute angle and the second end second acute angle are substantially oppositely disposed from each other. The second end tortuous access passageway is operational to allow the strap to be selectably manually positioned from the outer periphery portion to the second end slot and selectably manually positioned from the second end slot to the outer periphery portion, wherein the second end tortuous access passageway helps restrict the strap from inadvertently dislodging from the second end slot to the outer periphery portion.

BRIEF DESCRIPTION OF DRAWINGS

These and other objects of the present invention will become more readily appreciated and understood from a consideration of the following detailed description of the exemplary embodiments of the present invention when taken together with the accompanying drawings, in which.

REFERENCE NUMBERS IN DRAWINGS

Figure 1:
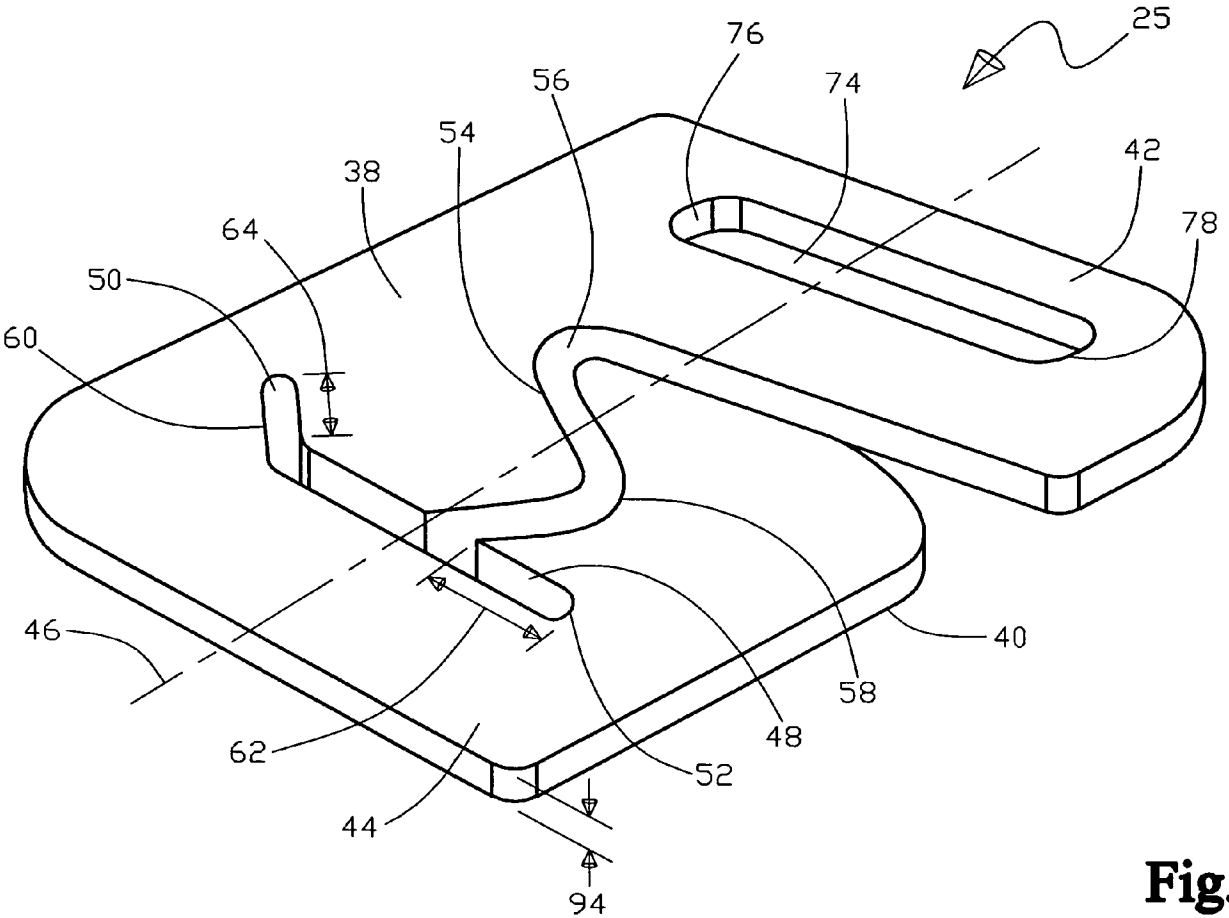
FIG. 1 is a perspective view of the strap retainer device with an angled slot extension.

25 Strap retainer device with angled slot extension portion 60
26 Strap retainer device without the angled slot extension portion 60
27 Strap retainer device that is double ended with angled slot extension portion 60
28 Strap retainer device that is double ended without the angled slot extension portion 60
29 Strap retainer device with angled slot extension portion 60 and a plurality of second end portions 44
30 Strap retainer device without the angled slot extension portion 60 and a plurality of second end portions 44
32 First object
34 Second object
36 Flexible strap or ribbon
37 Thickness of flexible strap 36
38 Body
40 Outer periphery portion of body 38
42 First end portion of body 38
44 Second end portion of body 38
46 Longitudinal axis of body 38
48 First 42 and second 44 end slot therethrough
50 Closed proximal end portion of first 42 and second 44 end slot 48 therethrough
52 Closed distal end portion of first 42 and second 44 end slot 48 therethrough
53 Open distal end portion of first 42 and second 44 end slot 48 therethrough
54 First 42 and second 44 end tortuous access passageway
56 First 42 and second 44 end first acute angle portion
58 First 42 and second 44 end second acute angle portion
60 First 42 and second 44 end angled portion slot extension
62 Selected first 42 and second 44 end distance
64 First 42 and second 44 end length of second end angled portion slot extension 60
66 Support surface
68 Channel for the support surface 66
70 Gap
72 Gap 70 width
74 First end 42 closed slot therethrough
76 End portion of first end 42 closed slot
78 Opposing end portion of first end 42 closed slot

80 Standard adjustable cargo strap
82 Loop on the standard adjustable cargo strap
84 Dog leash
86 Force
88 Radius for first acute angle portion 56 second acute angle portion 58
90 Radial movement
91 Lateral movement
92 "L" shaped portion of first end portion 42
94 Thickness of strap retainer devices 25, 26, 27, 28, 29, and 30

DETAILED DESCRIPTION

Figure 2:
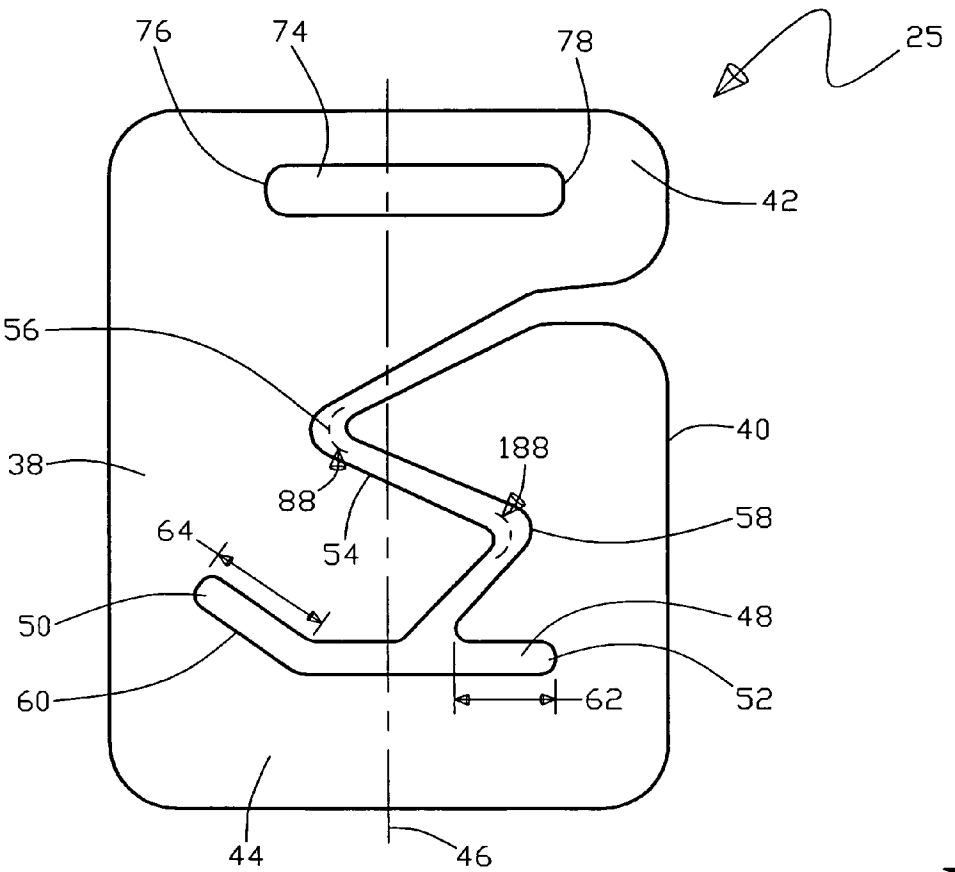
FIG. 2 is a flat pattern view of the strap retainer device with the angled slot extension.
Figure 3:
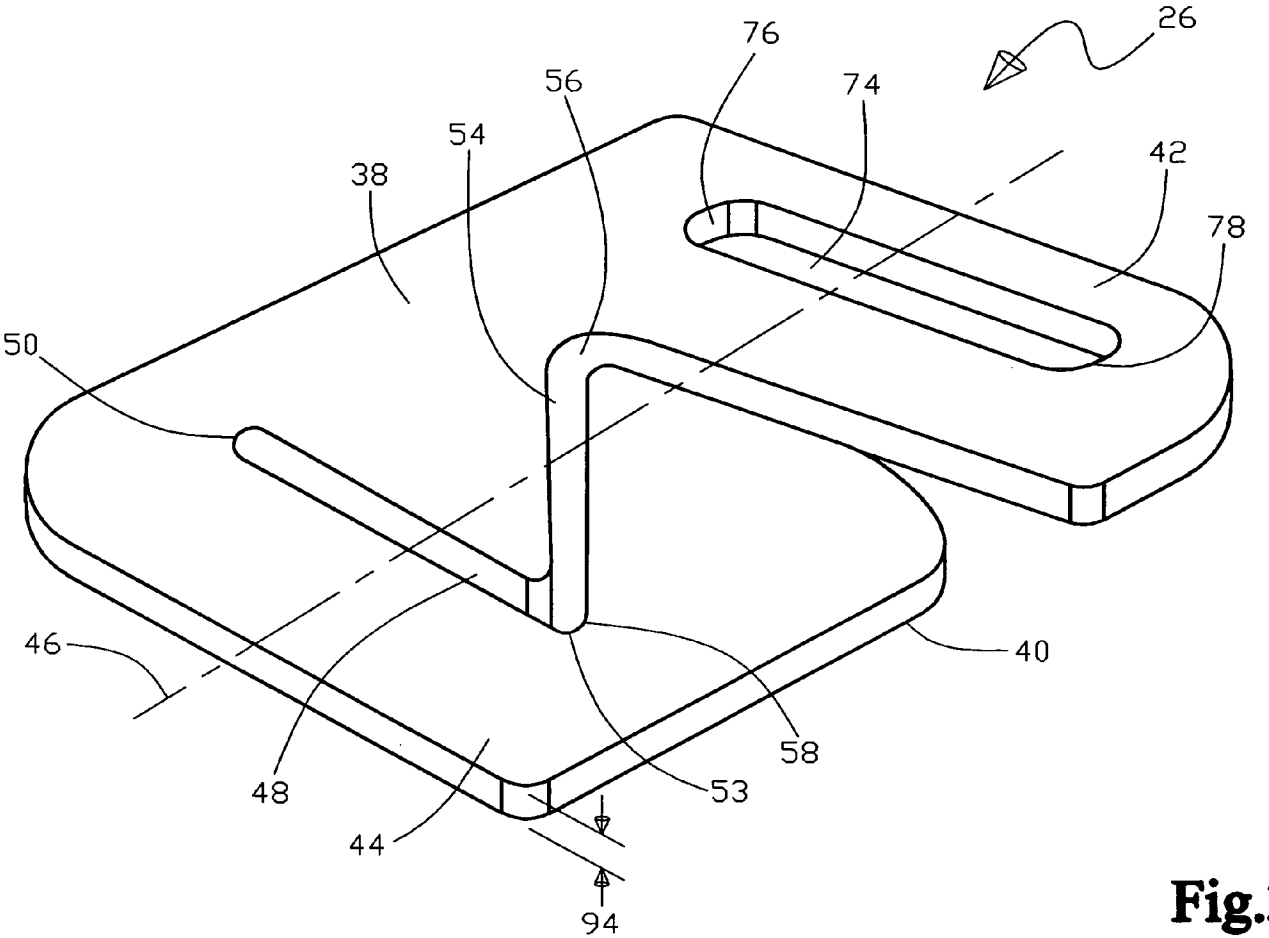
FIG. 3 is a perspective view of the strap retainer device.
Figure 4:
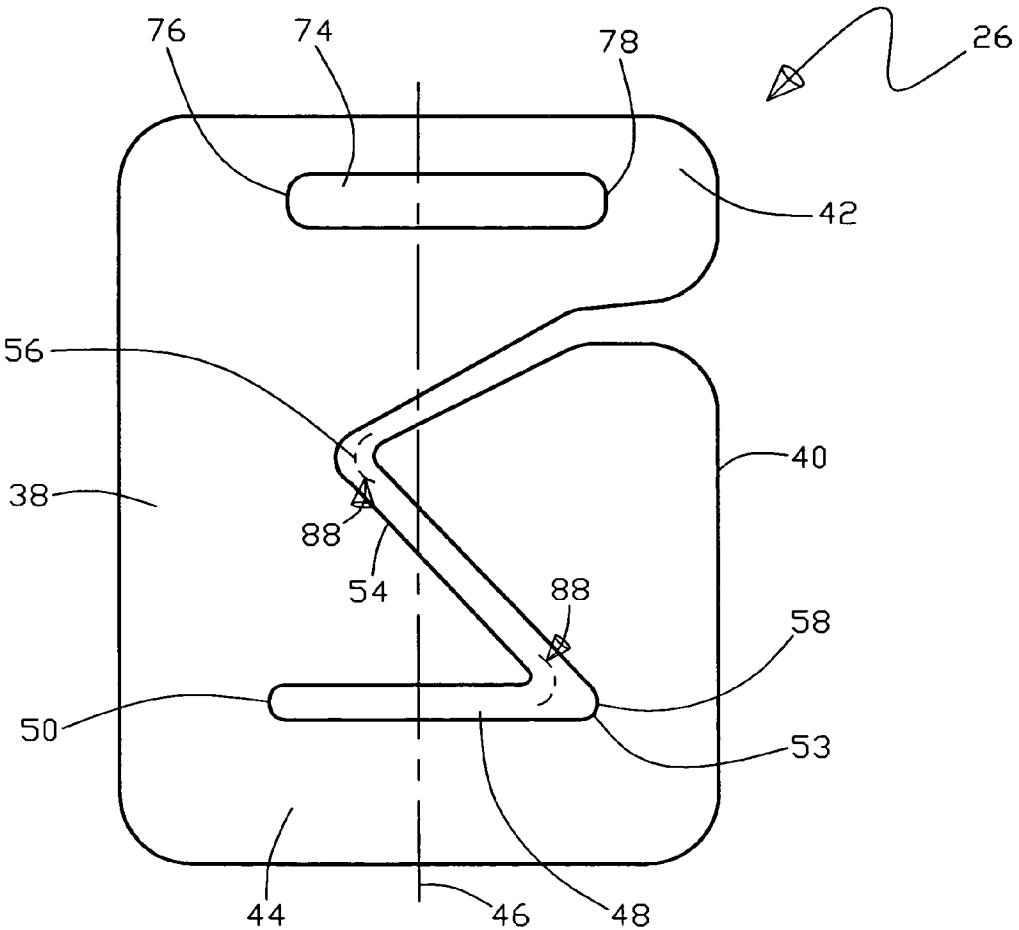
FIG. 4 is a flat pattern view of the strap retainer device.
Figure 5:
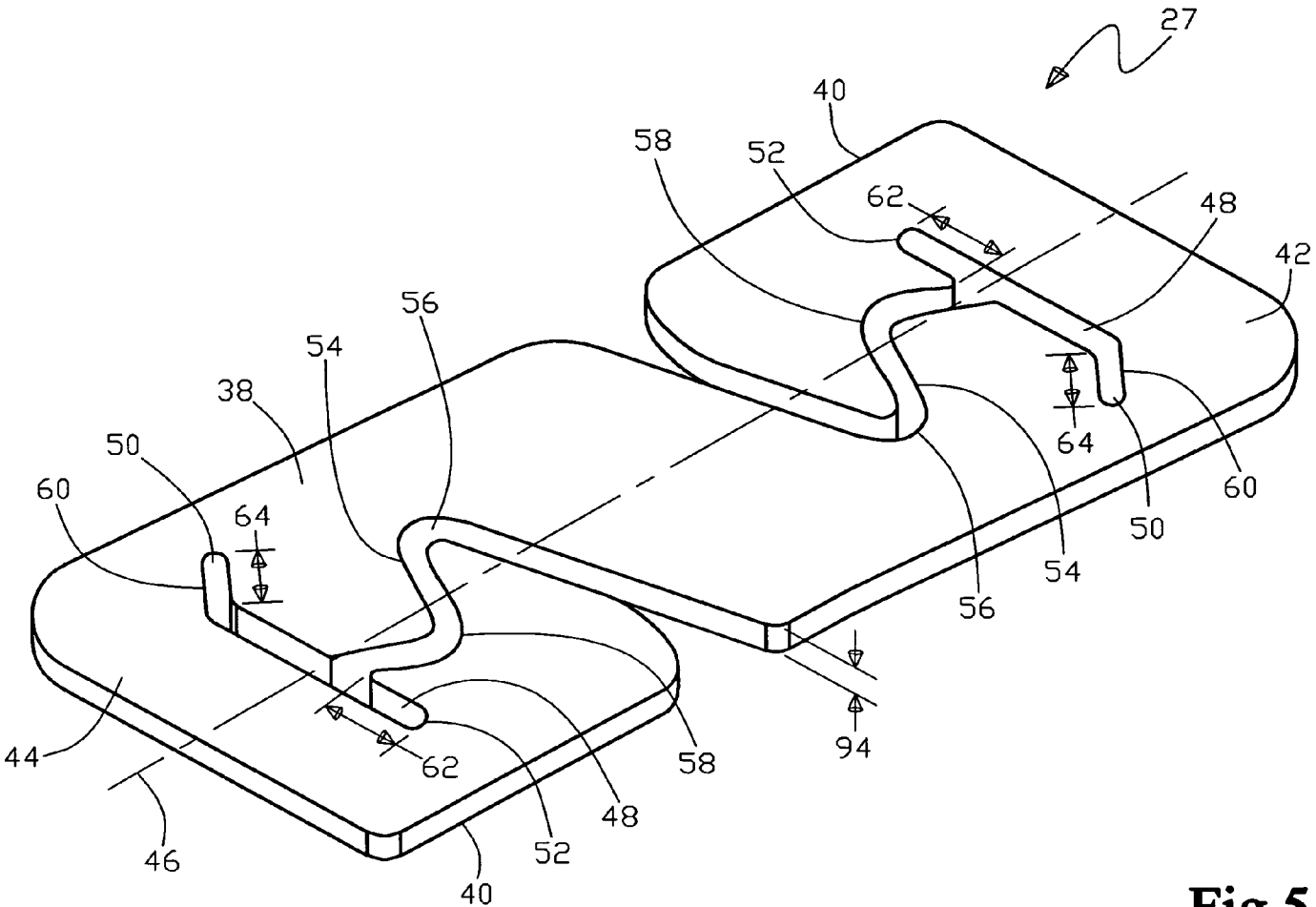
FIG. 5 is a perspective view of a double ended strap retainer device with the angled slot extension.
Figure 6:
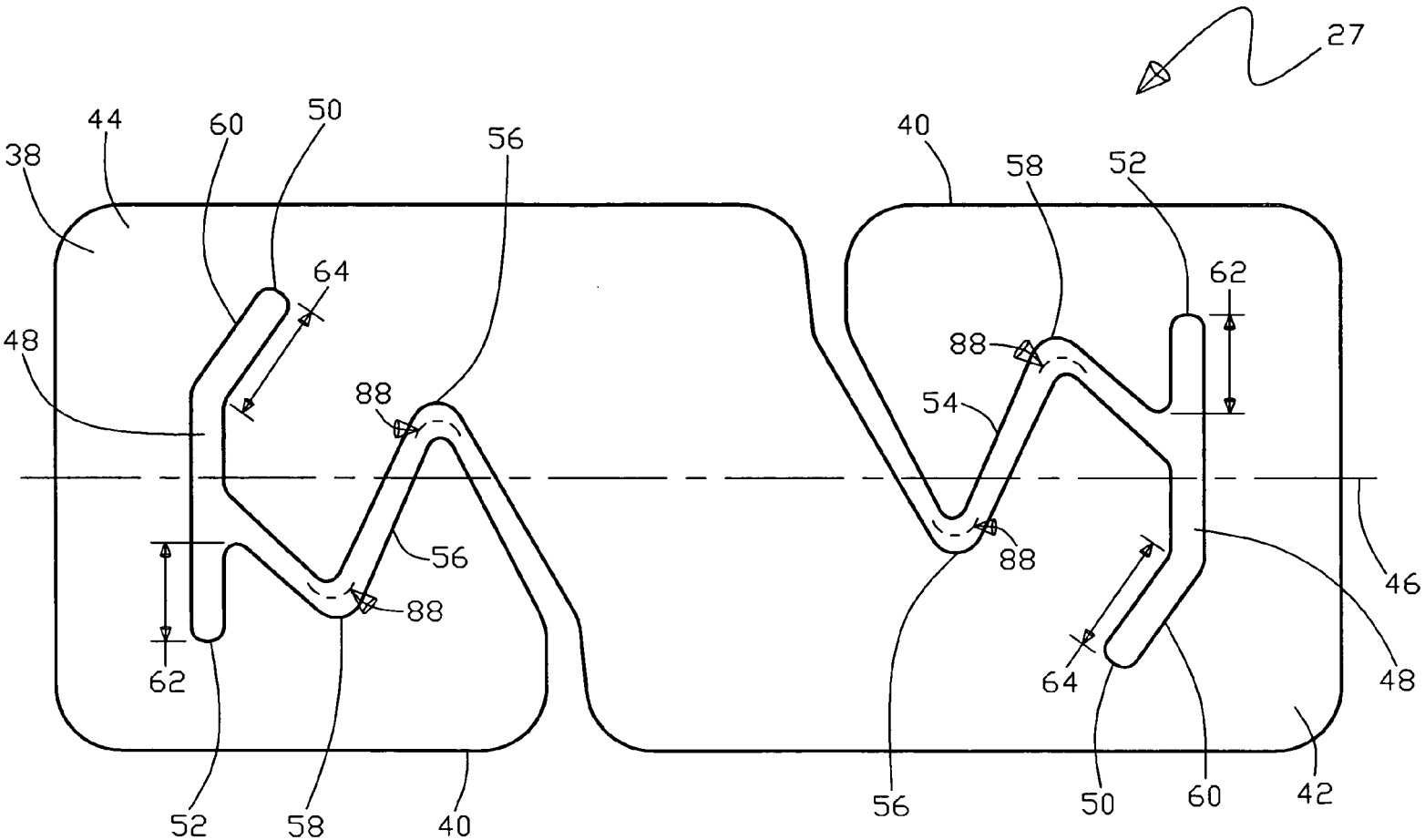
FIG. 6 is a flat pattern view of the double ended strap retainer device with the angled slot extension.
Figure 7:
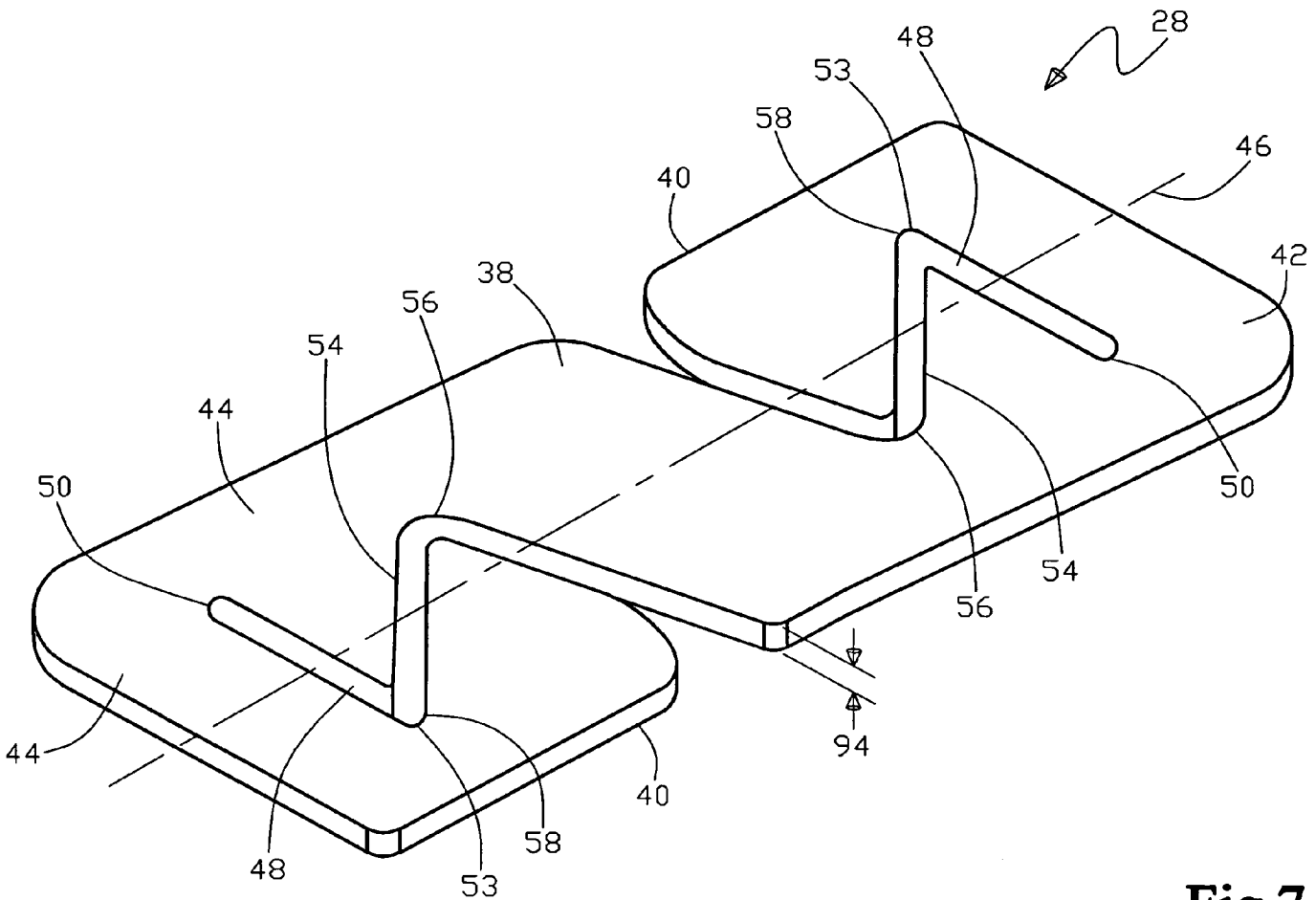
FIG. 7 is a perspective view of a double ended strap retainer device.
Figure 8:
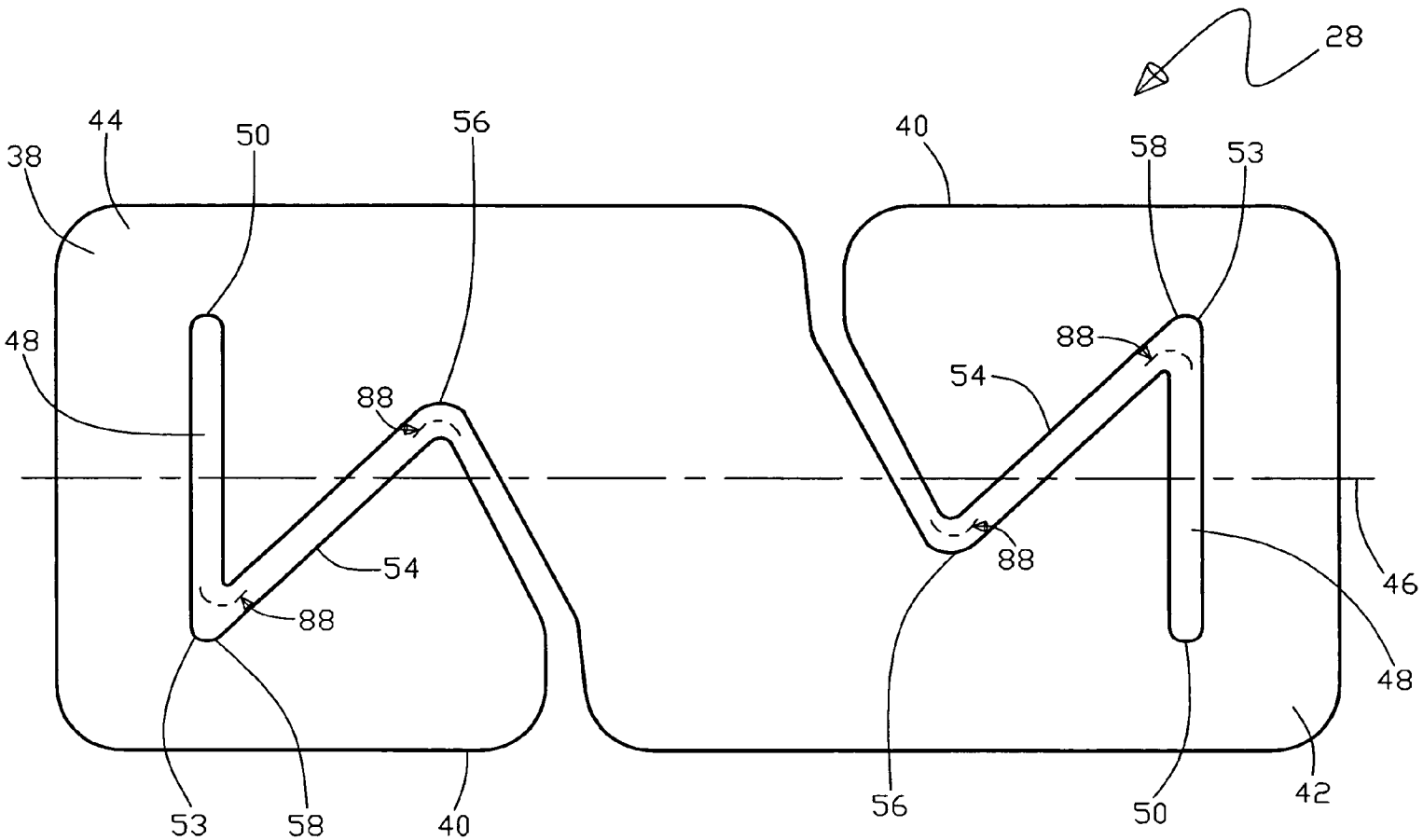
FIG. 8 is a flat pattern view of the double ended strap retainer device.
Figure 9:
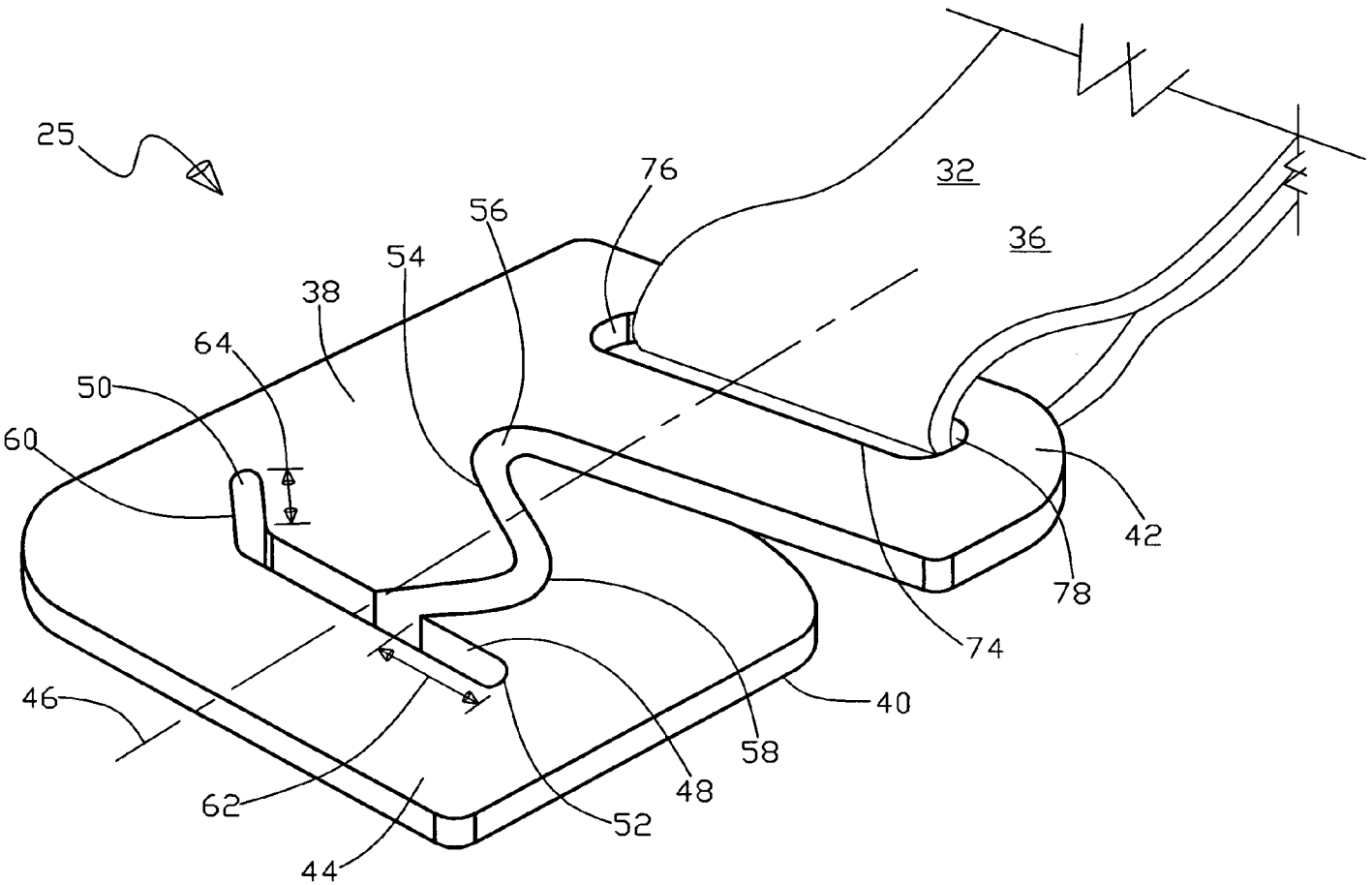
FIG. 9 is a perspective view of the strap retainer device with the angled slot extension showing a strap adjacent to an opposing first end portion.
Figure 10:
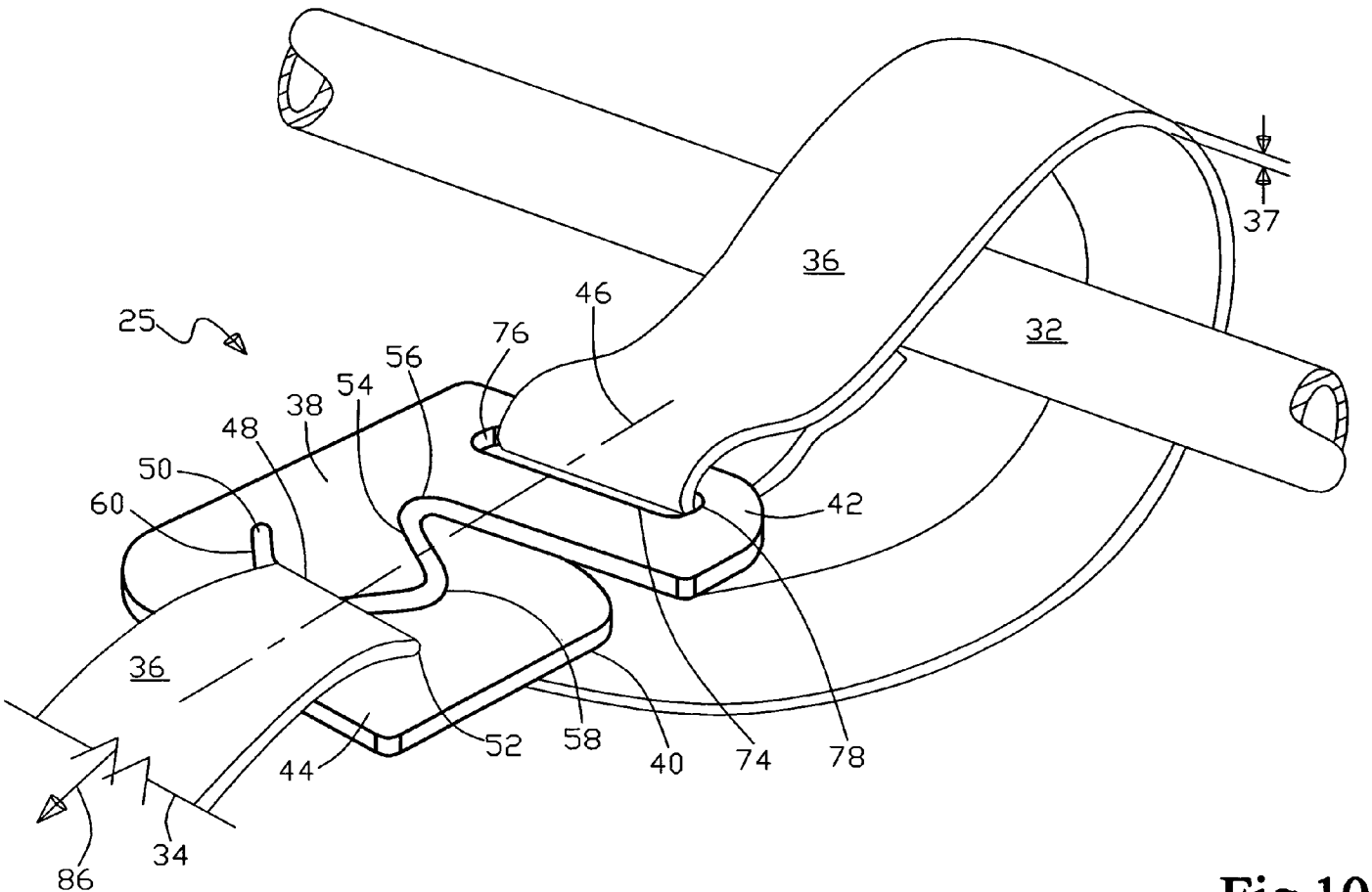
FIG. 10 shows a perspective view of a use drawing for the strap retainer device with the angled slot extension with the strap adjacent to the opposing first end portion looping around a first object.
Figure 23:
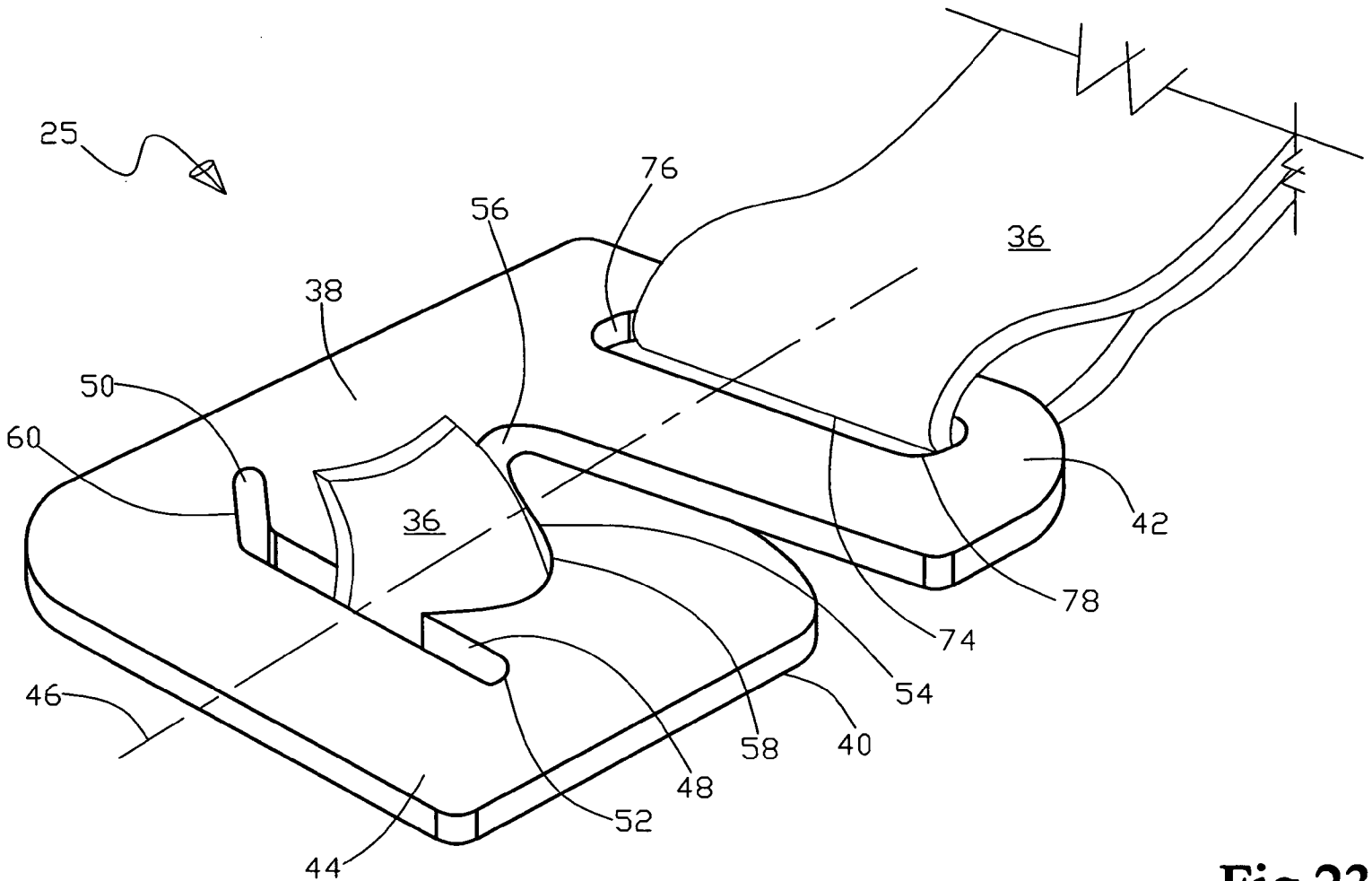
FIG. 23 shows a perspective view of a use drawing for the strap retainer device with the angled slot extension having the strap entering the slot from the tortuous access passageway adjacent to the second acute angle.
Figure 24:
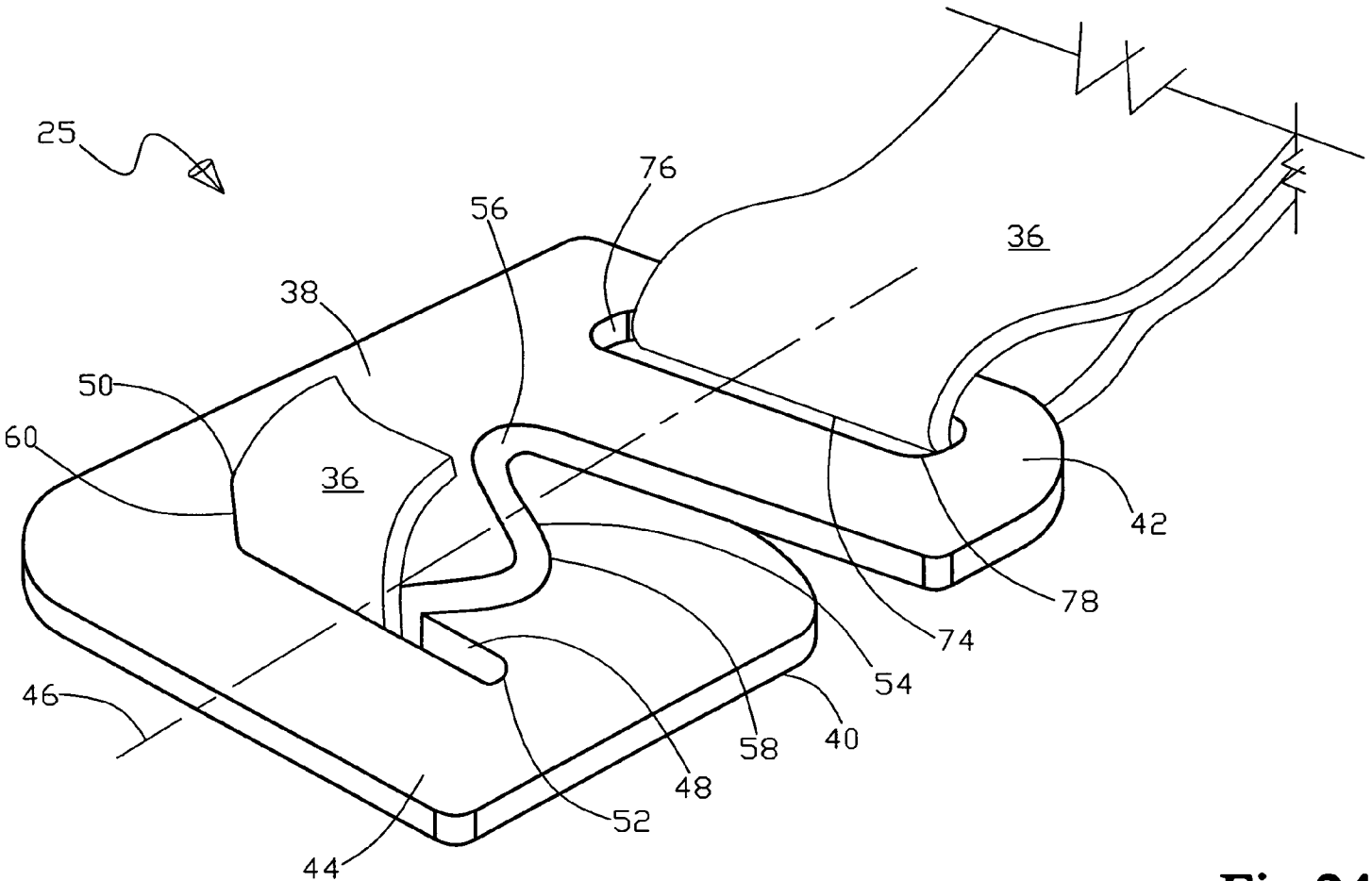
FIG. 24 shows a perspective view of a use drawing for the strap retainer device with the angled slot extension having the strap entering the angled slot extension, wherein the strap clears the tortuous access passageway for centering of the strap in the slot.

With initial reference to FIG. 1 shown is a perspective view of the strap retainer device 25 including an angled slot extension portion 60, FIG. 2 shows a flat pattern view of the strap retainer device 25 also including the angled slot extension portion 60, and FIG. 3 is a perspective view of the strap retainer device 26 without the angled slot extension portion 60. Further, FIG. 4 shows a flat pattern view of the strap retainer device 26 also without the angled slot extension portion 60, FIG. 5 shows a perspective view of a double ended strap retainer device 27 with the angled slot extension portions 60, and FIG. 6 is a flat pattern view of the double ended strap retainer device 27 with the angled slot extension portions 60. Continuing, FIG. 7 is a perspective view of a double ended strap retainer device 28 without the angled slot extension portions 60, FIG. 8 is a flat pattern view of the double ended strap retainer device 28 again without the angled slot extension portions 60, and FIG. 9 is a perspective view of the strap retainer device 25 with the angled slot extension portion 60 showing a strap 36 adjacent to an opposing first end portion 42. Note that the strap 36 is preferably defined as a narrow strip of flexible material such as fabric, leather, nylon, and the like where in the strap 36 has a high flexibility in its lengthwise axis, defined as "lengthwise stiffness" (parallel to the longitudinal axis 46 with strap 36 as shown in FIG. 10) and the strap 36 having reduced flexibility in an axis transverse to the longitudinal axis 36, defined as "lateral stiffness" in referring to FIG. 10. This is as opposed to use of the word "ribbon" that is sometimes used interchangeably with strap 36, wherein a ribbon is preferably defined as a long thin strip of fine material such as silk, satin, rayon, or the like that typically has a high degree of flexibility in both the ribbon's lengthwise axis, defined as "lengthwise stiffness" (parallel to the longitudinal axis 46 comparing to strap 36 as shown in FIG. 10) and in an axis transverse to the longitudinal axis 46, defined as "lateral stiffness" again in referring to FIG. 10. Keeping this distinction in mind between the strap 36 and the ribbon, the present invention relies to some extent on the strap 36 lateral stiffness being higher that the strap 36 lengthwise stiffness, wherein the strap 36 resists going through the tortuous passageway 54 as best shown in FIGS. 22, 23, and 24 as the tortuous passageway 54 requires the strap 36 to flex laterally.

Figure 11:
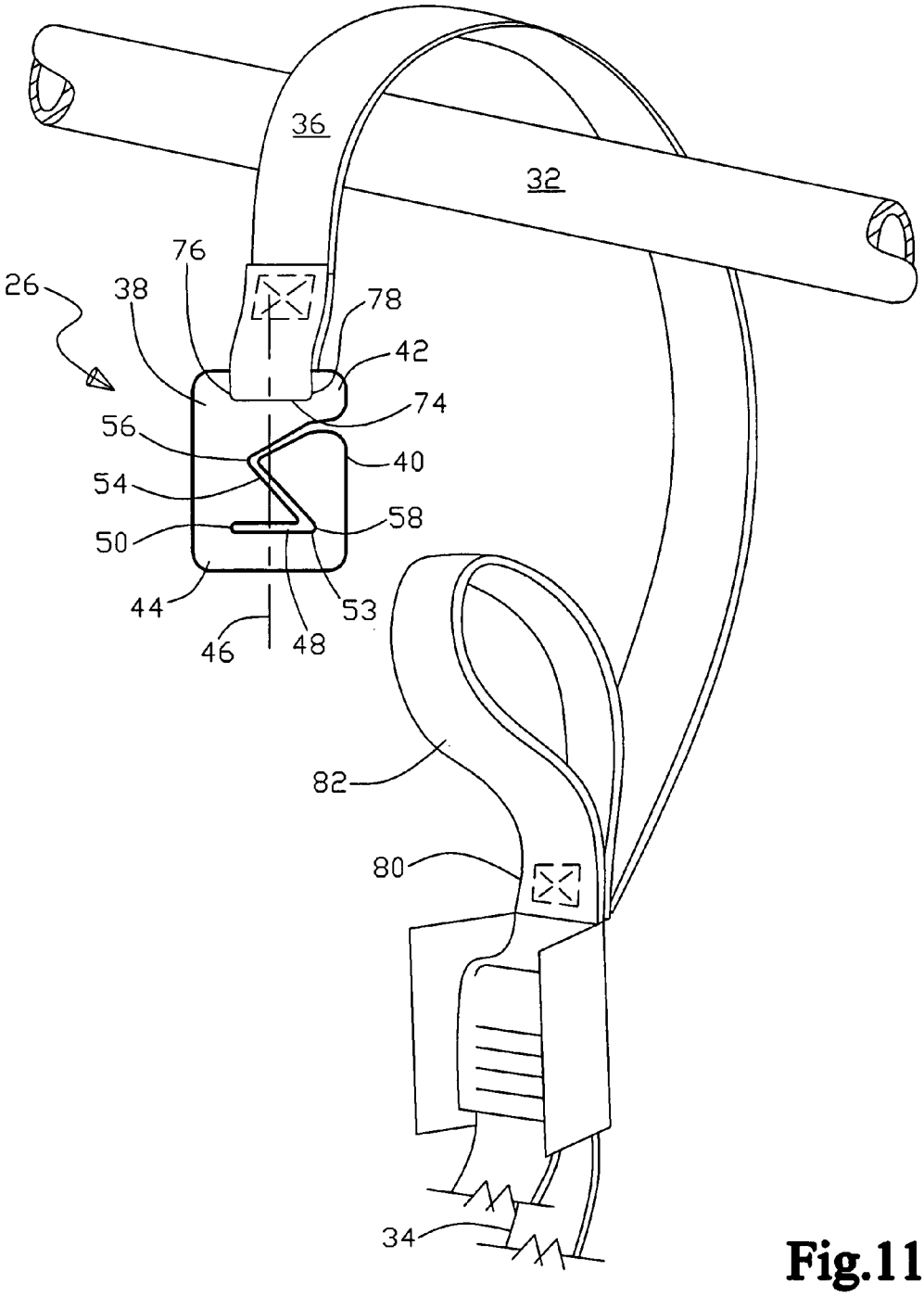
FIG. 11 shows a perspective view of a use drawing for the strap retainer device with the strap adjacent to the opposing first end portion looping around a first object, wherein the second end portion will removably engage a loop on a standard adjustable cargo strap.
Figure 12:
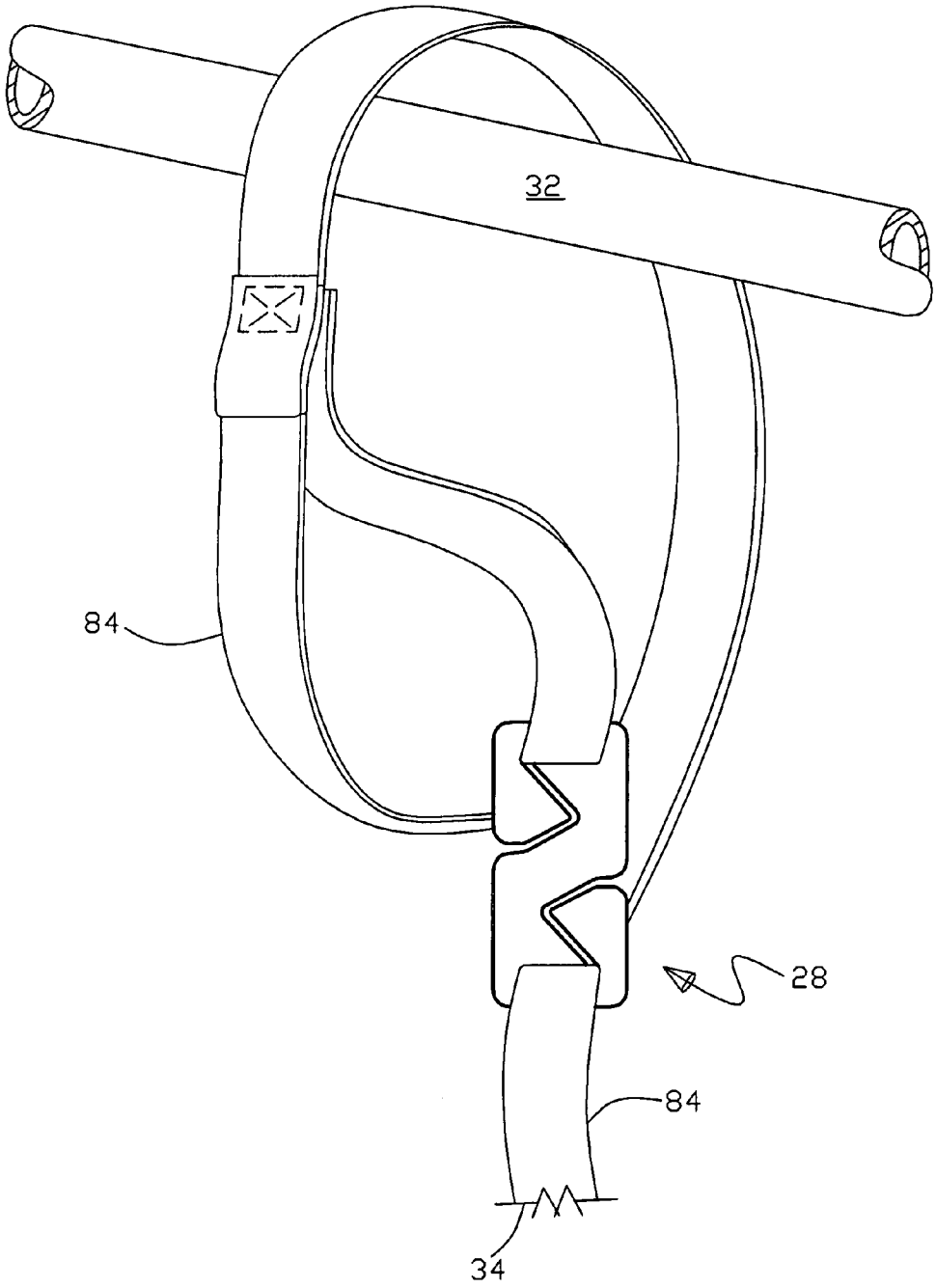
FIG. 12 is a perspective use view drawing showing the use of the doubled ended strap retainer device with a standard dog leash looped around a first object.
Figure 13:
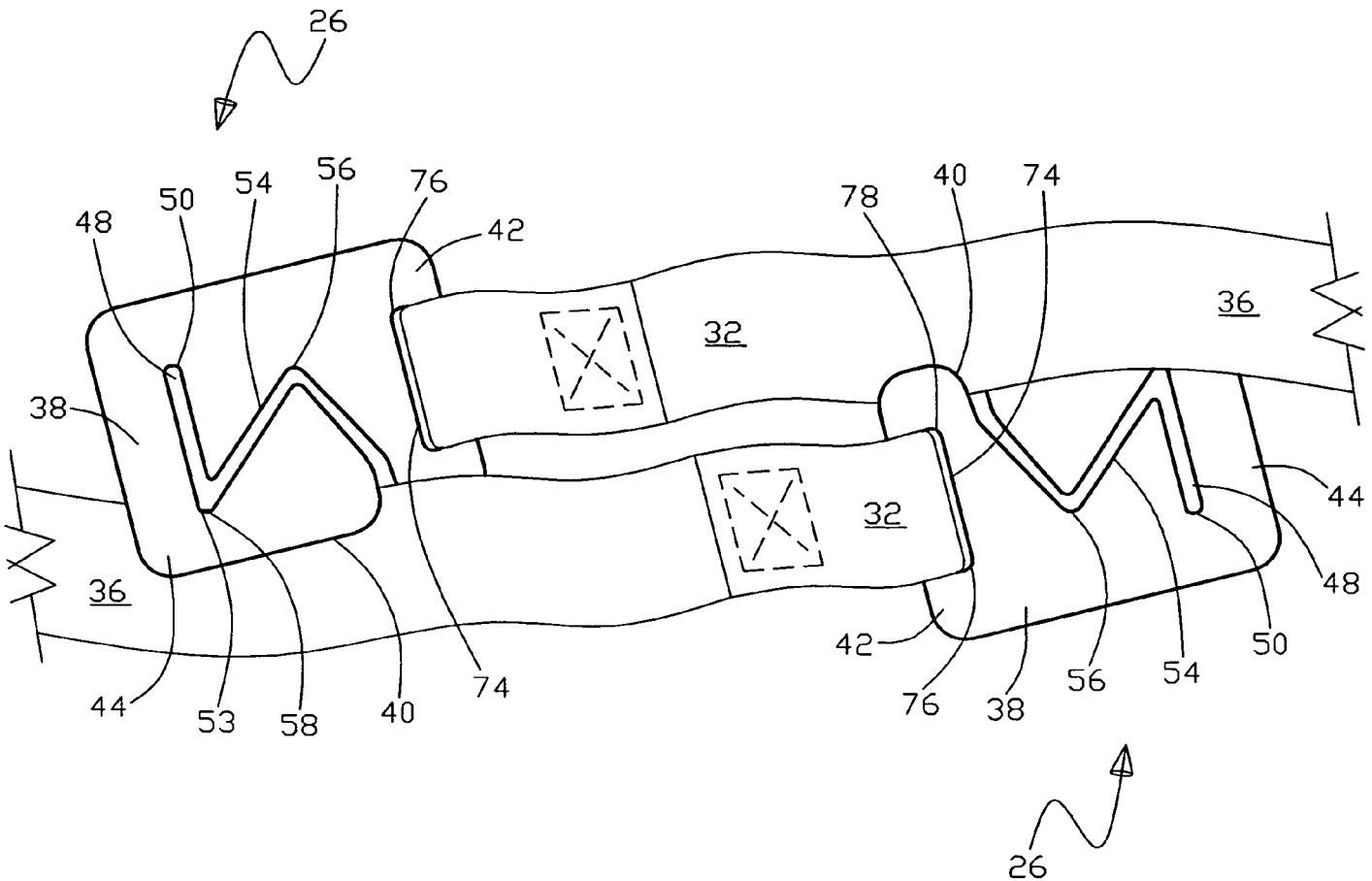
FIG. 13 is a perspective use view drawing showing the initial plural strap insertions into the strap retainer devices for the use of two strap retainer devices being joined together.
Figure 14:
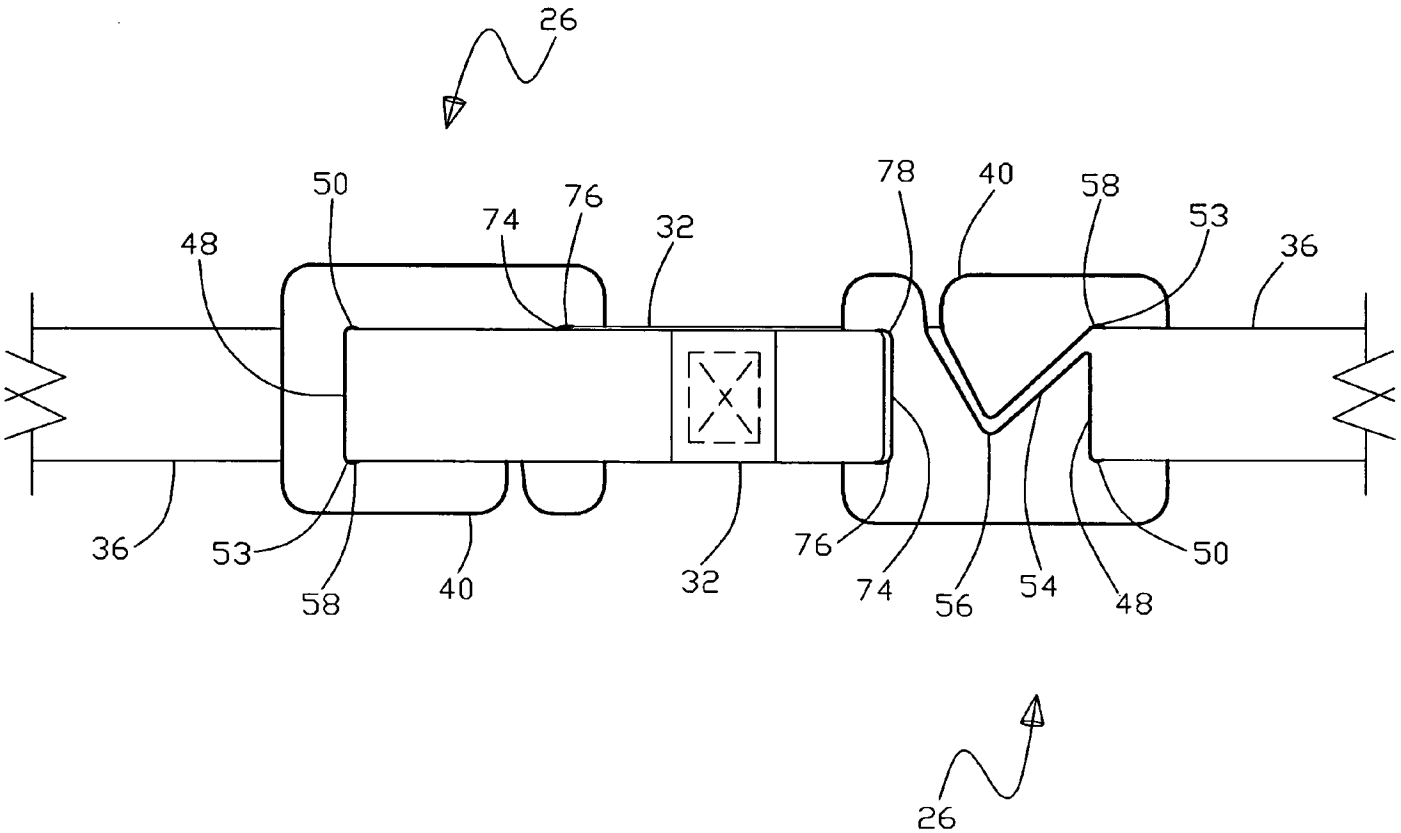
FIG. 14 is a perspective use view drawing showing the completed plural strap insertions into the strap retainer devices for the use of two strap retainer devices being joined together.
Figure 15:
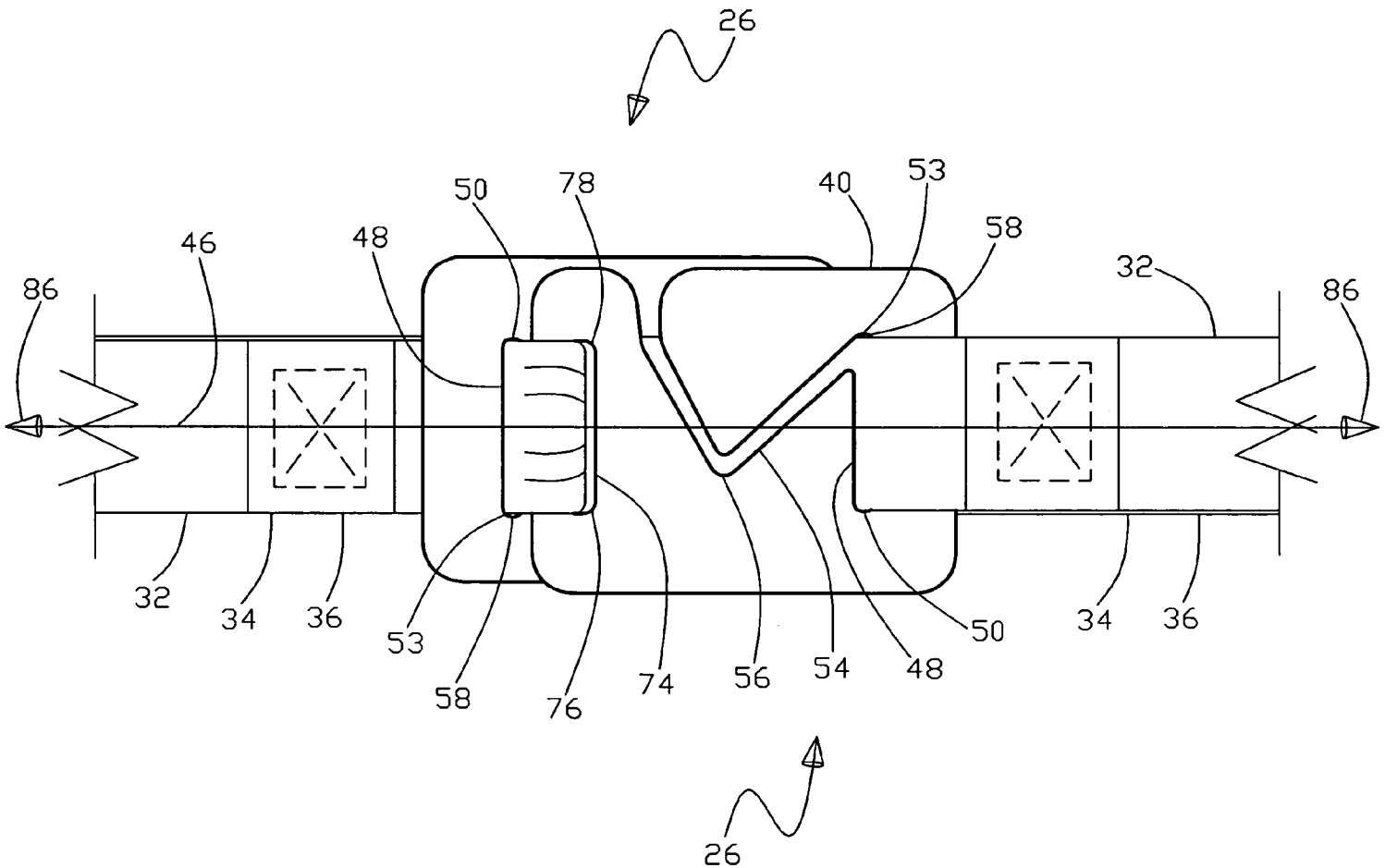
FIG. 15 is a perspective use view drawing showing the completed plural strap insertions into the strap retainer devices for the use of two strap retainer devices being joined together wherein force has been applied along the longitudinal axis of the free end of the strap resulting the strap retainer devices becoming adjacent to one another.
Figure 16:
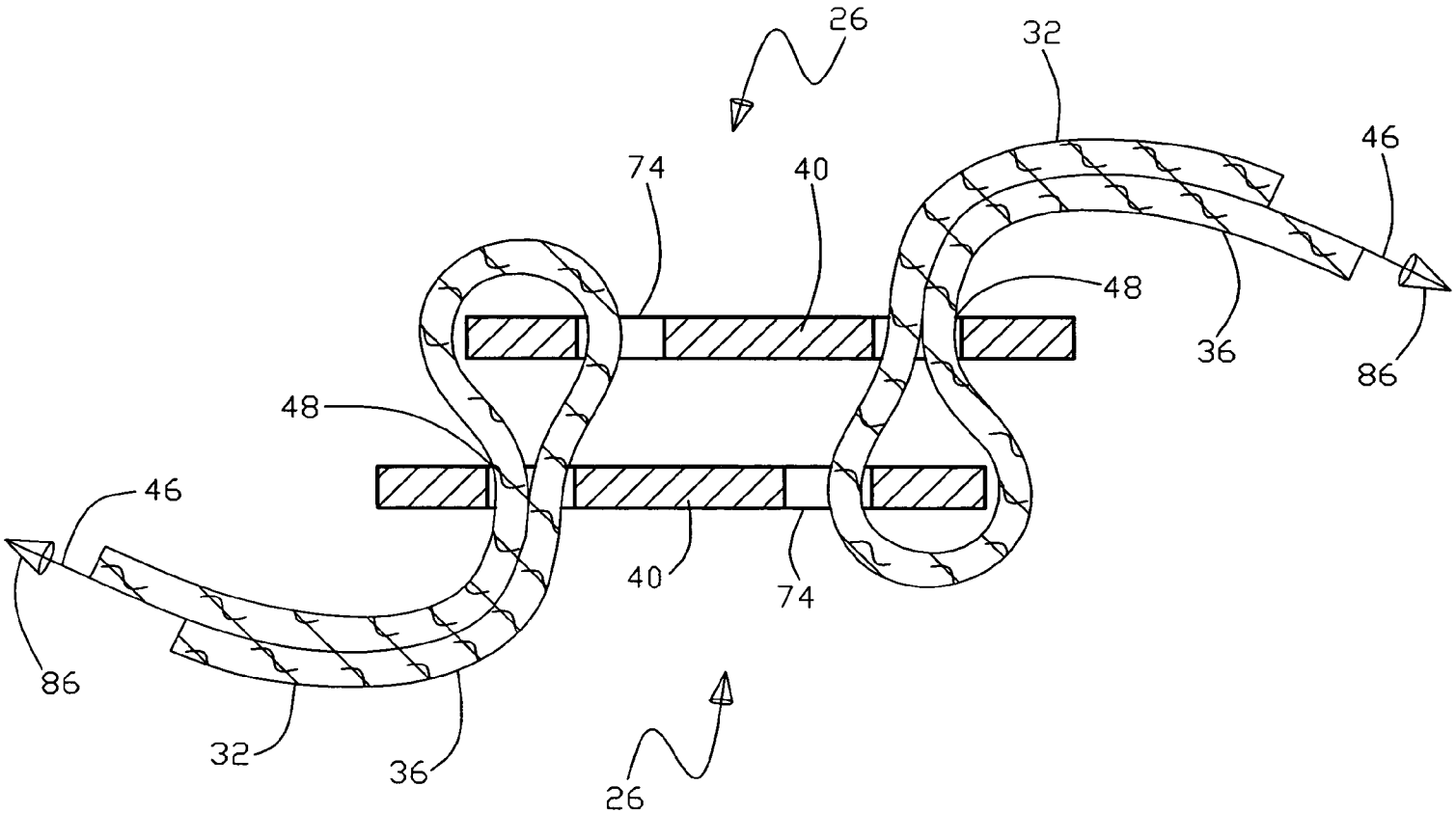
FIG. 16 is a side use view drawing of FIG. 15 showing the completed plural strap insertions into the strap retainer devices for the use of two strap retainer devices being joined together wherein force has been applied along the longitudinal axis of the free end of the strap resulting the strap retainer devices becoming adjacent to one another.

Next, FIG. 10 shows a perspective view of a use drawing for the strap retainer device 25 including the angled slot extension portion 60 with the strap 36 adjacent to the opposing first end portion 42 looping around a first object 32, thereby retaining the first object 32 to a second object 34, FIG. 11 shows a perspective view of a use drawing for the strap retainer device 26 with the strap 36 adjacent to the opposing first end portion 42 looping around a first object 32, thereby retaining the first object 32 to a second object 34, wherein the second end portion 44 will removably engage a loop 82 on a standard adjustable cargo strap 80, and FIG. 12 is a perspective use view drawing showing the use of the doubled ended strap retainer device 28 with a standard dog leash 84 looped around a first object 32, thereby retaining the first object 32 to a second object 34. Yet further, FIG. 13 is a perspective use view drawing showing the initial plural strap 36 insertions into the strap retainer devices 26 for the use of two strap retainer devices 26 being joined together, FIG. 14 is a perspective use view drawing showing the completed plural strap 36 insertions into the strap retainer devices 26 for the use of two strap retainer devices 26 being joined together, and FIG. 15 is a perspective use view drawing showing the completed plural strap 36 insertions into the strap retainer devices 26 for the use of two strap retainer devices 26 being joined together, wherein force 86 has been applied along the longitudinal axis 46 of the free end of the straps 36 resulting the strap retainer devices 26 becoming adjacent to one another as is best shown in FIG. 16. As FIG. 16 is a side use view drawing of FIG. 15 showing the completed plural strap 36 insertions into the strap retainer devices 26 for the use of two strap retainer devices 26 being joined together wherein force 86 has been applied along the longitudinal axis 46 of the free ends of the strap 36 resulting the strap retainer devices 26 becoming adjacent to one another.

Figure 17:
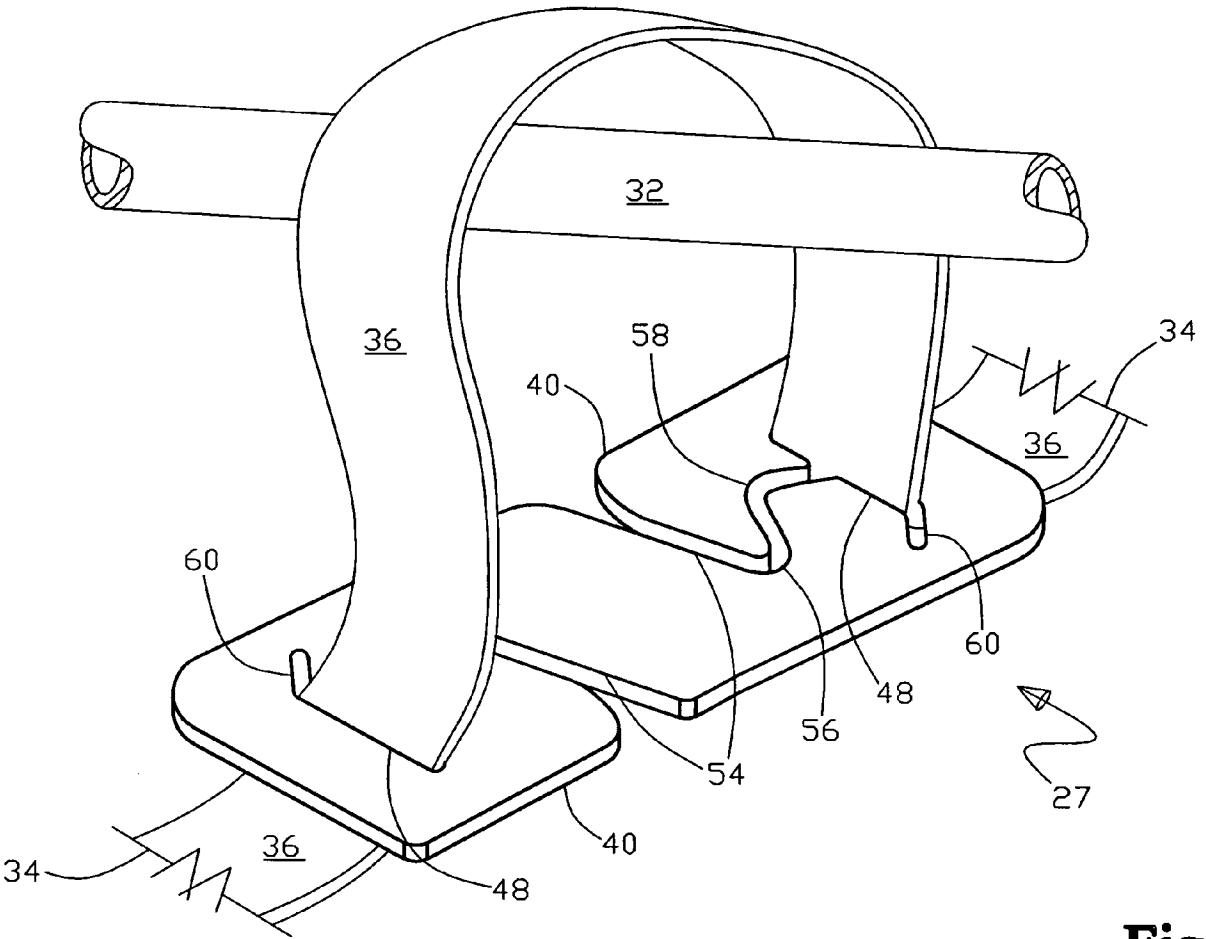
FIG. 17 is a perspective use view drawing of the double ended strap retainer device as shown in FIG. 5 with the angled slot extension portion, wherein a single strap is looped around a first object.
Figure 18:
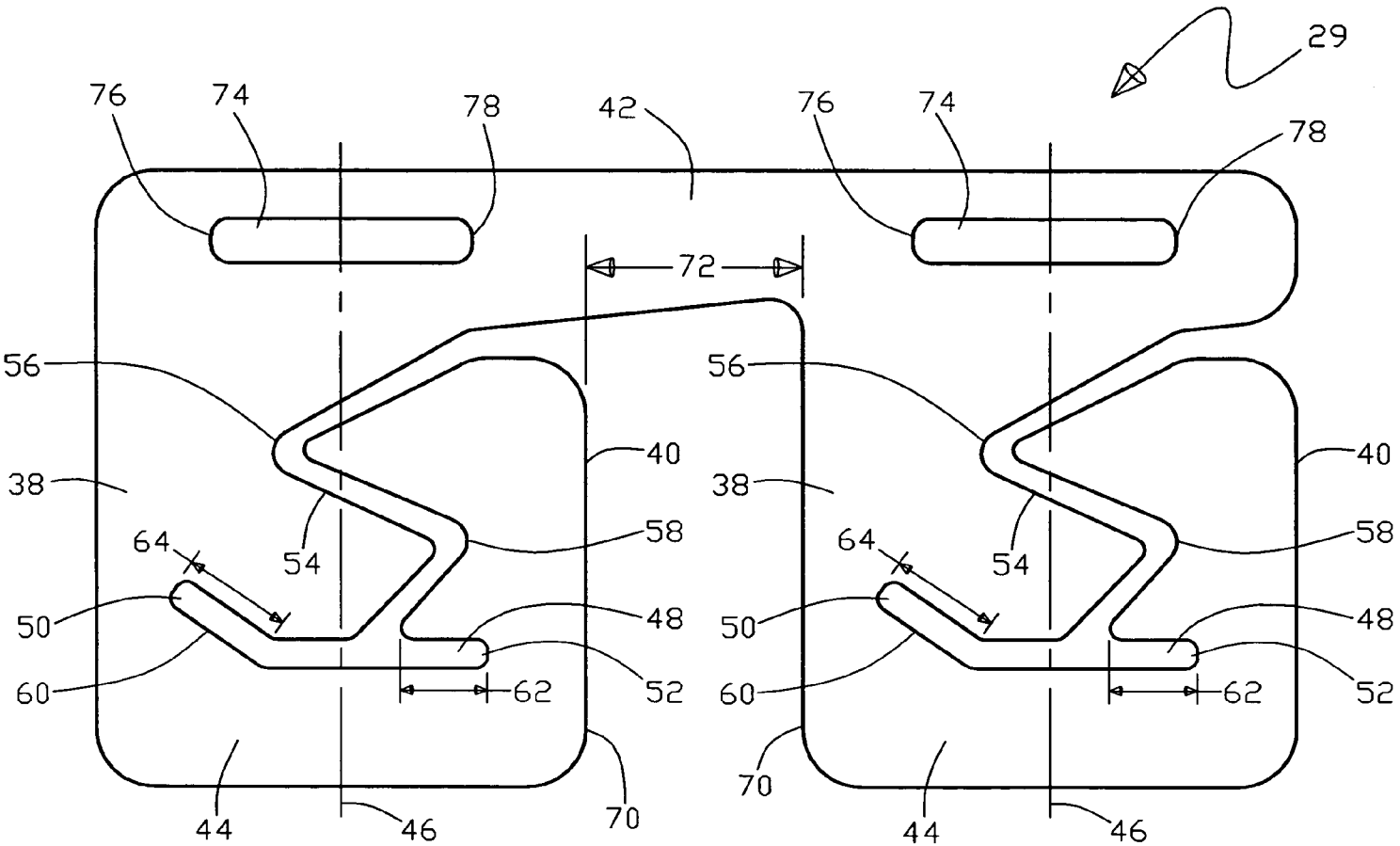
FIG. 18 is a flat pattern view of the strap retainer device with the angled slot extension portion, showing a plurality of strap retainer device second end portions substantially oppositely disposed from a first end portion of the strap retainer device.
Figure 19:
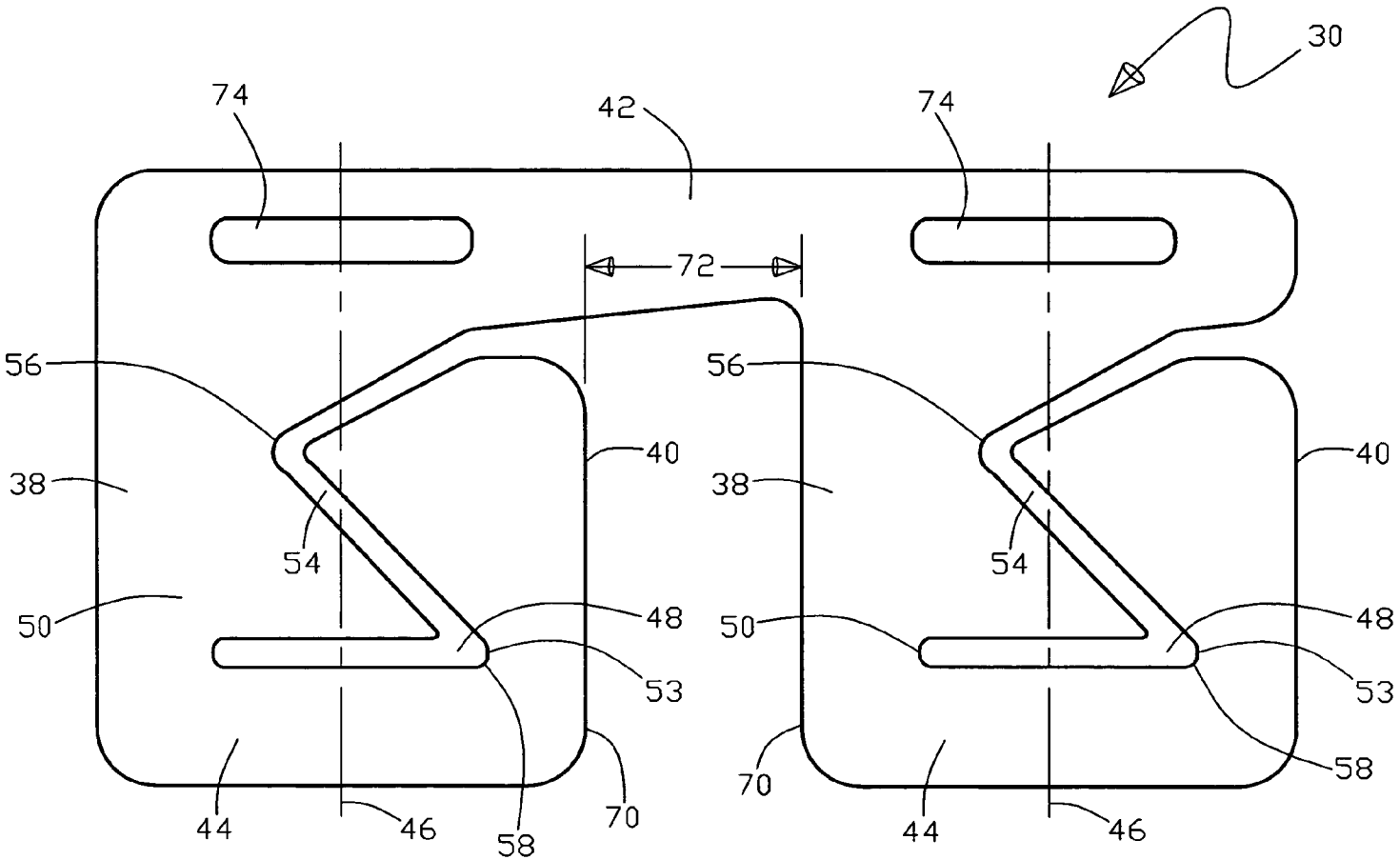
FIG. 19 is a flat pattern view of the strap retainer device, showing a plurality of strap retainer device second end portions substantially oppositely disposed from a first end portion of the strap retainer device.
Figure 20:
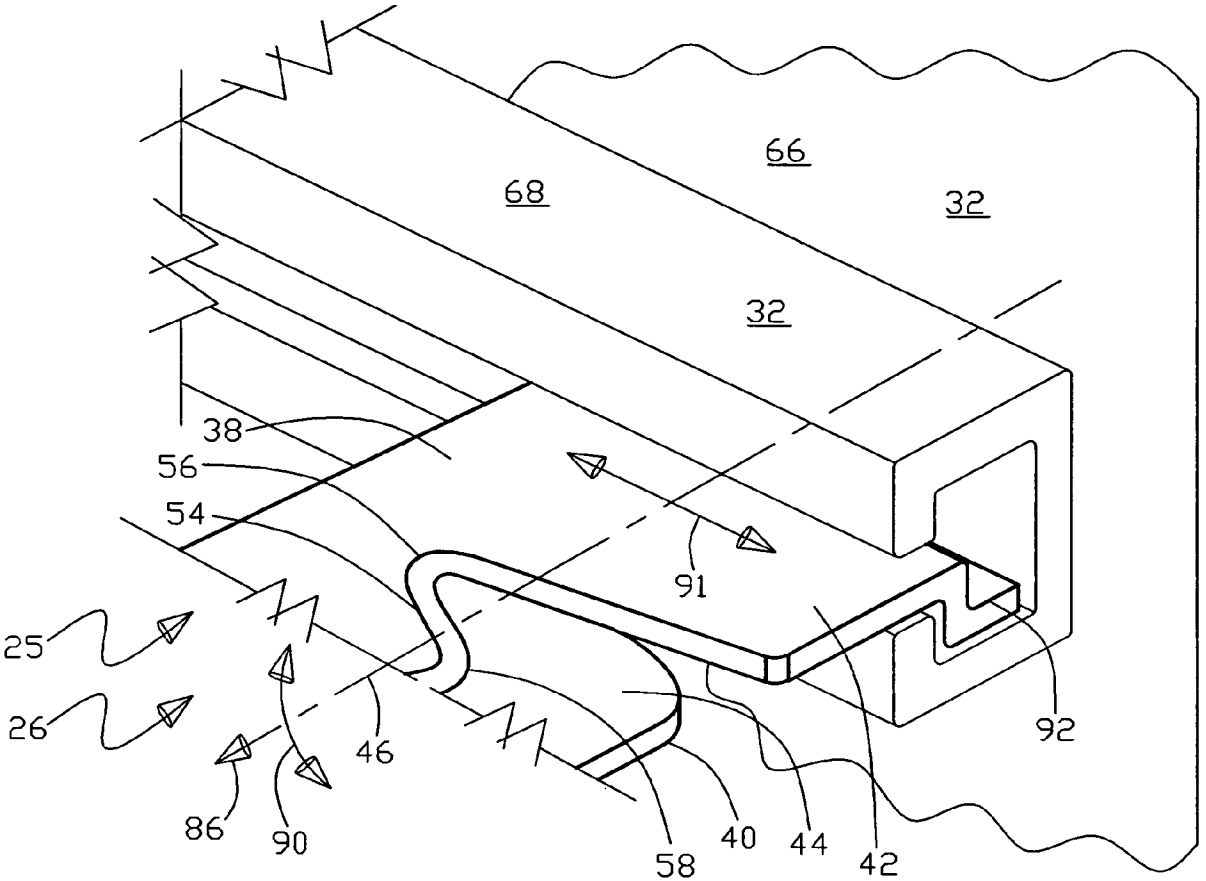
FIG. 20 is a perspective view of the strap retainer device, showing the first end portion being sized and configured to removably engage to a channel on a support surface.

Furthermore, FIG. 17 shows a perspective use view drawing of the double ended strap retainer device 27 as shown in FIG. 5 with the angled slot extension portion 60, wherein a single strap 36 is looped around a first object 32 thereby retaining the first object 32 to a second object 34. Next, FIG. 18 shows a flat pattern view of the strap retainer device 29 with the angled slot extension portion 60, showing a plurality of strap retainer device 29 second end portions 44 substantially oppositely disposed from a first end portion 42 of the strap retainer device 29. Continuing, FIG. 19 is a flat pattern view of the strap retainer device 30, showing a plurality of strap retainer device 30 second end portions 44 substantially oppositely disposed from a first end portion 42 of the strap retainer device 30. Continuing further, FIG. 20 is a perspective view of the strap retainer device 25 or 26, showing the first end portion 42 being sized and configured to removably engage to a channel 68 on a support surface 66.

Figure 21:
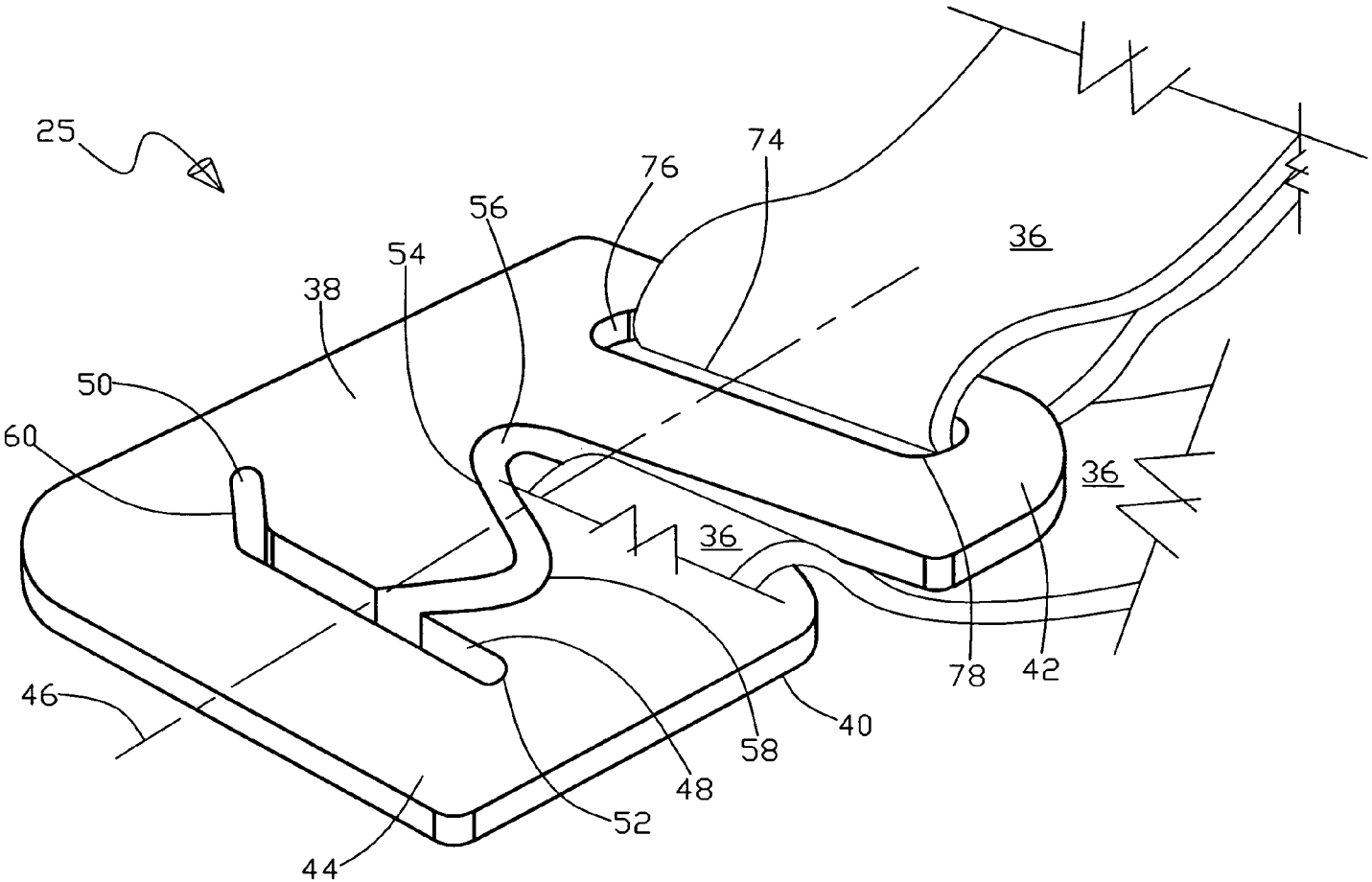
FIG. 21 shows a perspective view of a use drawing for the strap retainer device with the angled slot extension having the strap entering the tortuous access passageway adjacent to the outer periphery.
Figure 22:
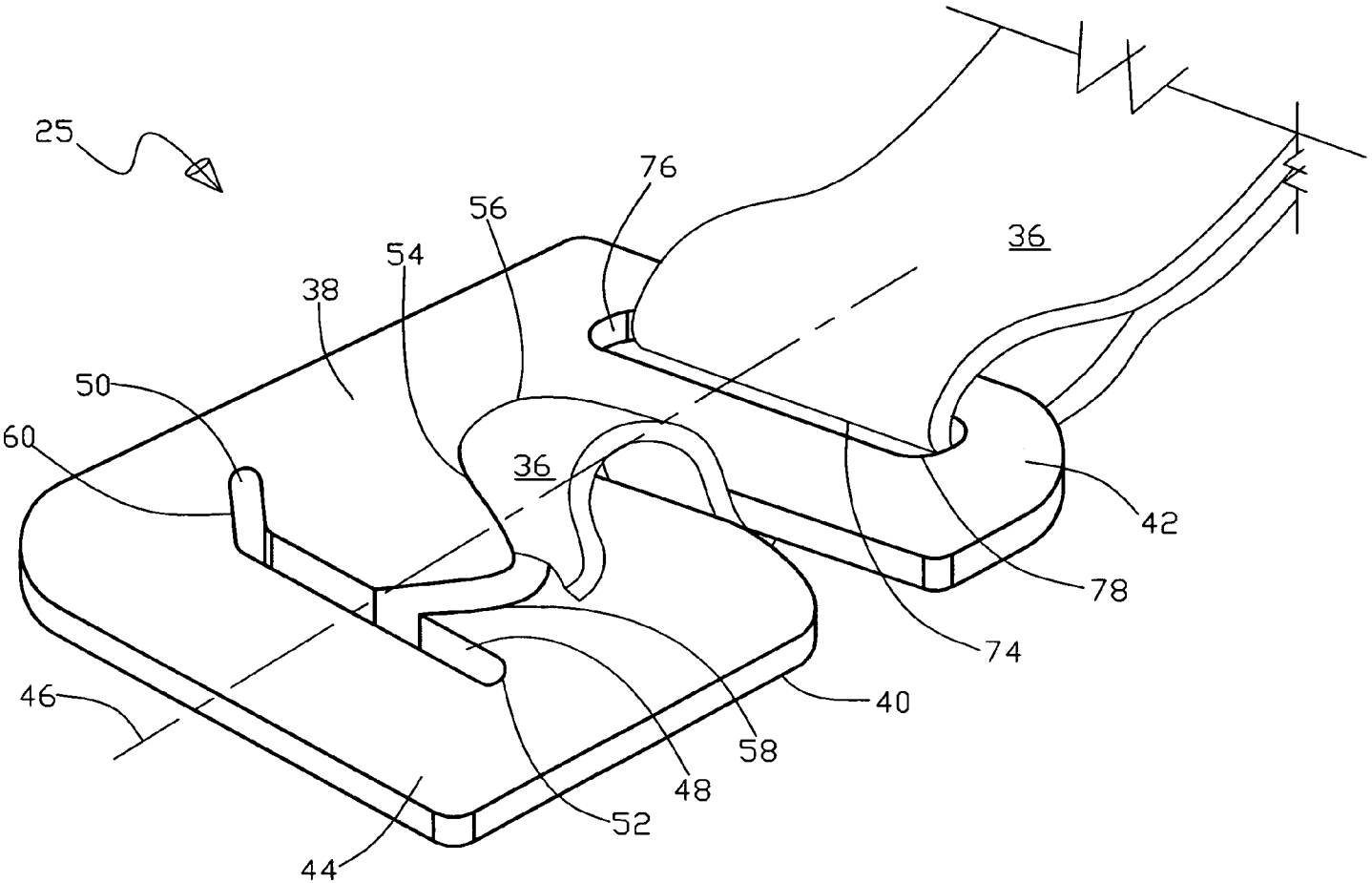
FIG. 22 shows a perspective view of a use drawing for the strap retainer device with the angled slot extension having the strap proceeding through the tortuous access passageway adjacent to the first and second acute angles.

Continuing, FIG. 21 shows a perspective view of a use drawing for the strap retainer device 25 with the angled slot extension 60 having the strap 36 entering the tortuous access passageway 54 adjacent to the outer periphery 49 and with FIG. 22 showing a perspective view of a use drawing for the strap retainer device 25 with the angled slot extension 60 having the strap 36 proceeding through the tortuous access passageway 54 adjacent to the first 56 and second 58 acute angles. Proceeding, FIG. 23 shows a perspective view of a use drawing for the strap retainer device 25 with the angled slot extension 60 having the strap 36 entering the slot 48 from the tortuous access passageway 54 adjacent to the second acute angle 58. Further, FIG. 24 shows a perspective view of a use drawing for the strap retainer device 25 with the angled slot extension 60 having the strap 36 entering the angled slot extension 60, wherein the strap 36 clears the tortuous access passageway 54 for centering of the strap 36 in the slot 48.

Thus the strap retainer device 25 for retaining a first object 32 to a second object 34, with the second object 34 preferably being a flexible strap 36, as best shown in FIG. 9, with the strap retainer device 25 including a body 38 that is generally planar with an outer periphery portion 40. The body 38 including a first end portion 42 and a substantially oppositely disposed second end portion 44, also the body 38 having a longitudinal axis 46 spanning between and through the first end portion 42 and the second end portion 44 as best shown in FIGS. 1 and 2. Wherein the first end portion 42 is adapted to attach to the first object 32, and as shown in FIG. 9, the first end portion 42 is adapted to attach to a first object 32 preferably being a flexible strap 36, however, the first end portion 42 could be fastened, welded, glued, removably engaged (as shown in FIG. 20), or adapted to attach in any manner to a desired first object 32.

Further, in referencing FIGS. 1 and 2, the second end portion 44 includes a second end slot 48 therethrough, wherein the second end slot 48 includes a closed proximal end portion 50 and a closed distal end portion 52, with the second end portion 44 also including a second end 44 tortuous access passageway 54 therethrough that extends from the outer periphery portion 40 to be in communication with the second end slot 48. The second end 44 tortuous passageway 54 is defined by a second end 44 first acute angle portion 56 and a second end 44 second acute angle portion 58, wherein the second end 44 first acute angle 56 and the second end 44 second acute angle 58 are substantially oppositely disposed from each other. Operationally, the second end 44 tortuous access passageway 54 is functional to allow the strap 36 to be selectably manually positioned from the outer periphery portion 40 to the second end 44 slot 48 and selectably manually positioned from the second end 44 slot 48 to the outer periphery portion 40, as best shown in looking at the sequence of FIGS. 13 and 14 or in looking at FIGS. 21, 22, 23, 24, and 10 in that order. Wherein the second end 44 tortuous access passageway 54 helps restrict the strap 36 from inadvertently dislodging from the second end 44 slot 48 to the outer periphery portion 40, thereby in an overall sense helping to retain the first object 32 to the second object 34 irrespective of the relative movement or positions of the first object 32 to the second object 34, even if the strap 36 momentarily slackens between the first object 32 and the second object 34.

As an option, the strap retainer device 25 as best shown in FIGS. 1 and 2, can further include to the second end 44 slot 48 closed proximal end 50 a second end 44 angled portion slot extension 60 and having the second end 44 tortuous access passageway 54 communication to the second end 44 slot 48 be adjacent to the second end 44 slot 48 closed distal end 52 at a selected second end 44 distance 62. Wherein functionally, the second end 44 angled portion slot extension 60 is operational to help the flexible strap 36 exit the second end 44 tortuous access passageway 54 to allow the strap 36 to reside in the second end 44 slot 48 as best shown in FIG. 10. Preferably distance 62 is about one-quarter (¼) of an inch, however, distance 62 could be more or less depending upon the thickness and width of the strap 36. In addition, the second end 44 angled portion slot extension 60 has a second end 44 length 64 that is substantially equal to the selected second end distance 62.

Again, as an option, the strap retainer device 25 outer periphery portion 40, second end 44 tortuous access passageway 54, specifically the first acute angle portion 56 and the second end second acute angle portion 58, plus the second end 44 slot 48 form a continuous contoured communication, as best shown in FIGS. 1 and 2, that is operational to allow the strap 36 to be smoothly selectably manually positioned from the outer periphery portion 40 to the second end 44 slot 48 and to be smoothly selectably manually positioned from the second end 44 slot 48 to the outer periphery portion 40 to minimize damage to the strap 36. Preferably, in referring to FIG. 2, the first acute angle portion 56 and the second end second acute angle portion 58 form a substantially smooth radius transition, wherein the radius 88 at about a mid point in the tortuous access passageway 54 is about three sixteenths (3/16) of an inch, however, radius 88 could be more or less depending upon the thickness and width of the strap 36.

Referring specifically to FIG. 20 the strap retainer device 25 or 26 optionally shows the first end portion 42 that is adapted to attach to the first object 32 that includes a support surface 66 having a support surface channel 68, wherein the first end portion 42 is sized and configured to removably engage the support surface 66 channel 68. Operationally, when there is a force 86 acting substantially along the longitudinal axis 46 as shown in FIG. 20, the first end portion 42 remains engaged to the channel 68 and thus the support surface 66 even when there is some degree of radial movement 90 and/or lateral movement 91 both being substantially transverse to the longitudinal axis 46. Thus to remove the first end 42 from the channel 68 requires that movement 90 be sequenced such that movement 90 be toward the "L" shaped portion 92 of the first end portion 42 followed by force 86, and then movement 90 opposite of the "L" shaped portion 92 to disengage the first end portion 42 from the channel 68. A further option for the strap retainer device 29 and 30 in referring specifically to FIGS. 18 and 19 is to have a single first end portion 42 serve a plurality of second end portions 44 that are spaced apart by a gap 70 having a width 72 that is at least equal to or greater than a strap 36 thickness 37 as best shown in FIG. 10.

Additionally, another option for the strap retainer device 27, referring specifically to FIGS. 5 and 6, is wherein the first object 32 is also a flexible strap 36 and the first end portion 42 is basically a mirror image of what the second end portion 44 is with the outer periphery 40, the slot 48, and the tortuous access passageway 54 that communicates between the outer periphery 40 and the slot 48. Thus the first end portion 42 includes a first end slot 48 therethrough, the first end slot 48 having a closed proximal end portion 50 and a closed distal end portion 52, the first end portion 42 also includes a first end 42 tortuous access passage way 54 therethrough that extends from the outer periphery portion 40 to be in communication with the first end 42 slot 48. The first end 42 tortuous passageway 54 is defined by a first end 42 first acute angle 56 and a first end 42 second acute angle 58, wherein the first end 42 first acute angle 56 and the first end 42 second acute angle 58 are substantially oppositely disposed from each other. The first end 42 tortuous access passageway 54 is operational to allow the strap 36 to be selectably manually positioned from the outer periphery portion 40 to the first end 42 slot 48 and selectably manually positioned from the first end 42 slot 48 to the outer periphery portion 40, wherein the first end 42 tortuous access passageway 54 helps restrict the strap 36 from inadvertently dislodging from the first end 42 slot 48 to the outer periphery portion 40.

As an option, also in referring to FIGS. 5 and 6, the strap retainer device 27 can further include to the first end 42 slot 48 closed proximal end 50 a first end 42 angled portion slot extension 60 and having the first end 42 tortuous access passageway 54 communication to the first end 42 slot 48 be adjacent to the first end 42 slot 48 closed distal end 52 at a selected first end 42 distance 62. Wherein functionally, the first end 42 angled portion slot extension 60 is operational to help the flexible strap 36 exit the first end 42 tortuous access passageway 54 to allow the strap 36 to reside in the first end 42 slot 48 as best shown in FIG. 10. Preferably distance 62 is about one-quarter (¼) of an inch, however, distance 62 could be more or less depending upon the thickness and width of the strap 36. In addition, the first end 42 angled portion slot extension 60 has a first end 42 length 64 that is substantially equal to the selected second end distance 62.

Also, as an option, again referring to FIGS. 5 and 6, the strap retainer device 27 outer periphery portion 40, first end 42 tortuous access passageway 54, specifically the first acute angle portion 56 and the second end second acute angle portion 58, plus the first end 42 slot 48 form a continuous contoured communication, that is operational to allow the strap 36 to be smoothly selectably manually positioned from the outer periphery portion 40 to the first end 42 slot 48 and to be smoothly selectably manually positioned from the first end 42 slot 48 to the outer periphery portion 40 to minimize damage to the strap 36. Preferably, in referring to FIG. 6, the first acute angle portion 56 and the second end second acute angle portion 58 form a substantially smooth radius transition, wherein the radius 88 at about a mid point in the tortuous access passageway 54 is about three sixteenths (3/16) of an inch, however, radius 88 could be more or less depending upon the thickness and width of the strap 36.

Alternatively, in referring to FIGS. 3 and 4, the strap retainer device 26 is shown for retaining a first object 32 to a second object 34, with the second object 34 preferably being a flexible strap 36, as best shown in FIG. 13, with the strap retainer device 26 including a body 38 that is generally planar with an outer periphery portion 40. The body 38 including a first end portion 42 and a substantially oppositely disposed second end portion 44, also the body 38 having a longitudinal axis 46 spanning between and through the first end portion 42 and the second end portion 44 as best shown in FIGS. 3 and 4. Wherein the first end portion 42 is adapted to attach to the first object 32, and as shown in FIG. 13, the first end portion 42 is adapted to attach to a first object 32 preferably being a flexible strap 36, however, the first end portion 42 could be fastened, welded, glued, removably engaged (as shown in FIG. 20), or adapted to attach in any manner to a desired first object 32.

Further, in referencing FIGS. 3 and 4, the second end portion 44 includes a second end slot 48 therethrough, wherein the second end slot 48 includes a closed proximal end portion 50 and an open distal end portion 53, with the second end portion 44 also including a second end 44 tortuous access passageway 54 therethrough that extends from the outer periphery portion 40 to be in communication with the second end slot 48 open distal end 53. The second end 44 tortuous passageway 54 is defined by a second end 44 first acute angle portion 56 and a second end 44 second acute angle portion 58, wherein the second end 44 first acute angle 56 and the second end 44 second acute angle 58 are substantially oppositely disposed from each other. Operationally, the second end 44 tortuous access passageway 54 is functional to allow the strap 36 to be selectably manually positioned from the outer periphery portion 40 to the second end 44 slot 48 and selectably manually positioned from the second end 44 slot 48 to the outer periphery portion 40, as best shown in looking at the sequence of FIGS. 13 and 14. Wherein the second end 44 tortuous access passageway 54 helps restrict the strap 36 from inadvertently dislodging from the second end 44 slot 48 to the outer periphery portion 40, thereby in an overall sense helping to retain the first object 32 to the second object 34 irrespective of the relative movement or positions of the first object 32 to the second object 34.

Also, as an option, again referring to FIGS. 3 and 4, the strap retainer device 26 outer periphery portion 40, second end 44 tortuous access passageway 54, specifically the first acute angle portion 56 and the second end second acute angle portion 58, plus the second end 44 slot 48 form a continuous contoured communication, that is operational to allow the strap 36 to be smoothly selectably manually positioned from the outer periphery portion 40 to the second end 44 slot 48 and to be smoothly selectably manually positioned from the second end 44 slot 48 to the outer periphery portion 40 to minimize damage to the strap 36. Preferably, in referring to FIG. 4, the first acute angle portion 56 and the second end second acute angle portion 58 form a substantially smooth radius transition, wherein the radius 88 at about a mid point in the tortuous access passageway 54 is about three sixteenths (3/16) of an inch, however, radius 88 could be more or less depending upon the thickness and width of the strap 36.

Additionally, another option for the strap retainer device 28, referring specifically to FIGS. 7 and 8, is wherein the first object 32 is also a flexible strap 36 and the first end portion 42 is basically a mirror image of what the second end portion 44 is with the outer periphery 40, the slot 48, and the tortuous access passageway 54 that communicates between the outer periphery 40 and the slot 48. Thus the first end portion 42 includes a first end slot 48 therethrough, the first end slot 48 having a closed proximal end portion 50 and an open distal end portion 53, the first end portion 42 also includes a first end 42 tortuous access passageway 54 therethrough that extends from the outer periphery portion 40 to be in communication with the first end 42 slot 48. The first end 42 tortuous passageway 54 is defined by a first end 42 first acute angle 56 and a first end 42 second acute angle 58, wherein the first end 42 first acute angle 56 and the first end 42 second acute angle 58 are substantially oppositely disposed from each other. The first end 42 tortuous access passageway 54 is operational to allow the strap 36 to be selectably manually positioned from the outer periphery portion 40 to the first end 42 slot 48 and selectably manually positioned from the first end 42 slot 48 to the outer periphery portion 40, wherein the first end 42 tortuous access passageway 54 helps restrict the strap 36 from inadvertently dislodging from the first end 42 slot 48 to the outer periphery portion 40.

Also, as an option, again referring to FIGS. 7 and 8, the strap retainer device 28 outer periphery portion 40, first end 42 tortuous access passageway 54, specifically the first acute angle portion 56 and the second end second acute angle portion 58, plus the first end 42 slot 48 form a continuous contoured communication, that is operational to allow the strap 36 to be smoothly selectably manually positioned from the outer periphery portion 40 to the first end 42 slot 48 and to be smoothly selectably manually positioned from the first end 42 slot 48 to the outer periphery portion 40 to minimize damage to the strap 36. Preferably, in referring to FIG. 8, the first acute angle portion 56 and the second end second acute angle portion 58 form a substantially smooth radius transition, wherein the radius 88 at about a mid point in the tortuous access passageway 54 is about three sixteenths (3/16) of an inch, however, radius 88 could be more or less depending upon the thickness and width of the strap 36.

For all of the embodiments of the strap retainer device 25, 26, 27, 28, 29, and 30 the preferred material of construction is steel plate, alternatively other materials of construction would include aluminum plate, plastics, composites, or other materials that would have similar strength of materials characteristics and environmental considerations (corrosion, weather, and the like) as the aforementioned materials. The preferred thickness 94 for all of the embodiments of the strap retainer device 25, 26, 27, 28, 29, and 30 is about one-eighth (1/8) of an inch, however, the thickness as 94 could be more or less than this value depending upon the characteristics of the material. The primary limitation on strength for the strap retainer devices 25, 26, 27, 28, 29, and 30 for force loading along the longitudinal axis 46 is the portion between the closed proximal end 50 and the outer periphery 40 being stressed as a cantilever beam by the strap 36 residing in the slot 48 acting through force 86 as best shown in FIG. 10. The preferred strength for the strap retainer devices 25, 26, 27, 28, 29, and 30 along the longitudinal axis is about fifteen hundred (1,500) pounds force for the materials of construction being steel plate at a thickness 94 of one-eighth (⅛) of an inch. Higher or lower strengths would be acceptable depending upon the conditions of use.

METHOD OF USE

FIGS. 9-20 show a myriad of uses for the strap retainer devices 25, 26, 27, 28, 29, and 30, the following method of use is for the basic use of the strap retainer device 25 as best shown in FIG. 9 that is a method of selectively retaining a first object 32 to a second object 34, comprising the steps of: Firstly, providing a strap retainer device 25 that includes a body 38 with an outer periphery portion 40, the body 38 including a first end portion 42 and an oppositely disposed second end portion 44, wherein the second end portion 44 includes a second end 44 slot 48 therethrough. The second end 44 slot 48 having a closed proximal end 50 and a closed distal end 52, the second end portion 44 also includes a second end 44 tortuous access passageway 54 therethrough that extends from the outer periphery portion 40 to be in communication with the second end 44 slot 48. The second end 44 tortuous passageway 54 is defined by a second end 44 first acute angle 56 and a second end 44 second acute angle 58, wherein the second end 44 first acute angle 56 and the second end 44 second acute angle 58 are substantially oppositely disposed from each other. Wherein the second end 44 slot 48 closed proximal end 50 further comprises a second end angled portion slot extension 60 and the second end 44 tortuous access passageway 54 communication to the second end 44 slot 48 is adjacent to the second end 44 slot 48 closed distal end 52 at a selected second end 44 distance 62.

A further step is to provide a strap 36, wherein the first end portion 42 is adapted to attach to the strap 36, see FIG. 9, the strap 36 also including an oppositely disposed end that is adapted to attach to the second object 34 as best shown in FIG. 10. Continuing a next step, is in grasping manually the strap retainer device 25 and the strap 36 and then looping the strap 36 around the first object 32 also as shown in FIG. 10. Following is a step of inserting the strap 36 into the second end 44 tortuous access passageway 54 adjacent to the outer periphery portion 40 as best shown in FIG. 21, a next step is in continuing to feed the strap 36 through the second end 44 tortuous passageway 54 deforming the strap 36 laterally to negotiate the second end 44 first acute angle 56 and the oppositely disposed second end 44 second acute angle 58 until the second end 44 slot 48 is reached as best shown in FIGS. 22 and 23. Continuing, a further step is pushing the strap 36 into the second end 44 slot 48 and continuing to push the strap 36 into the second end 44 angled portion slot extension 60 until the strap 36 cleans the second end 44 tortuous passageway 54 as best shown in FIG. 24. Ultimately, then a step of centering the strap 36 in the second end 44 slot 48 by reversibly pushing the strap 36 out of the second end 44 angled portion slot extension 60 until the strap 36 is adjacent to the second end 44 slot 48 closed distal end 52, as best shown in FIG. 10, wherein the strap retainer device 25 substantially retains the strap 36 in the second end 44 slot 48 irrespective of the relevant positions of the first object 32 and the second object 34, even if the strap 36 momentarily slackens.

To disengage the strap 36 from the strap retainer device 25 involves a reversing step of pushing the strap 36 into the second end 44 angled portion slot extension 60 until the strap 36 lengthwise edge is adjacent to the second end 44 tortuous passageway 54, essentially going from what is shown in FIG. 10 to what is shown in FIG. 24 for the positioning of the strap 36. Continuing, the next step involves feeding the strap 36 through the second end 44 tortuous passageway 54 deforming the strap 36 laterally to negotiate the second end 44 second acute angle 58 and the oppositely disposed second end 44 first acute angle 56, essentially going from what is shown in FIG. 24 to what is shown in FIG. 23, proceeding until what is shown in FIG. 22, until the strap 36 reaches the outer periphery portion 40, as best shown in FIG. 21, wherein the strap 36 can be removed from the strap retainer device 25 thus selectively unretaining the first object 32 from the second object 34.

CONCLUSION

Accordingly, the present invention of a strap retainer device has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

The invention claimed is:

1. A strap retainer device for retaining a first object to a second object, the second object being a flexible strap, said device comprising:

(a) a body that is generally planar with an outer periphery portion, said body including a first end portion and a substantially oppositely disposed second end portion, said body having a longitudinal axis spanning between and through said first end portion and said second end portion;

(i) said first end portion is adapted to attach to the first object; and (ii) said second end portion includes a second end slot therethrough, said second end slot having a closed proximal end and a closed distal end, said second end portion also includes a second end tortuous access passageway therethrough that extends from said outer periphery portion to be in communication with said second end slot, said second end tortuous passageway is defined by a second end first acute angle and a second end second acute angle, wherein said second end first acute angle and said second end second acute angle are substantially oppositely disposed from each other, said second end tortuous access passageway is operational to allow the strap to be selectably manually positioned from said outer periphery portion to said second end slot and selectably manually positioned from said second end slot to said outer periphery portion, wherein said second end tortuous access passageway helps restrict the strap from inadvertently disloding from said second end slot to said outer periphery portion, said second end slot closed proximal end further comprises a second end angled portion extension and said second end tortuous access passageway communication to said second end slot is adjacent to said second end slot closed distal end at a selected second end distance, said second end angled portion extension is operational to help the flexible strap exit said second end tortuous access passageway to allow the strap to reside in said second end slot.

2. A strap retainer device for retaining a first object to a second object according to claim 1 wherein said second end angled portion extension has a second end length that is substantially equal to said selected second end distance.

3. A strap retainer device for retaining a first object to a second object according to claim 1 wherein said outer periphery portion, said second end tortuous access passageway, said second end slot, and said second end angled portion extension form a continuous contoured communication that is operational to allow the strap to be smoothly selectably manually positioned from said outer periphery portion to said second end slot and to be smoothly selectably manually positioned from said second end slot to said outer periphery portion to minimize damage to the strap.

4. A method of selectively retaining a first object to a second object, comprising the steps of:

(a) providing a strap retainer device that includes a body with an outer periphery portion, said body including a first end portion and an oppositely disposed second end portion, said second end portion includes a second end slot therethrough, said second end slot having a closed proximal end and a closed distal end, said second end portion also includes a second end tortuous access passageway therethrough that extends from said outer periphery portion to be in communication with said second end slot, said second end tortuous passageway is defined by a second end first acute angle and a second end second acute angle, wherein said second end first acute angle and said second end second acute angle are substantially oppositely disposed from each other, wherein said second end slot closed proximal end further comprises a second end angled portion extension and said second end tortuous access passageway communication to said second end slot is adjacent to said second end slot closed distal end at a selected second end distance;

(b) providing a strap, wherein said first end portion is adapted to attach to the strap, the strap also including an oppositely disposed end that is adapted to attach to the second object;

(c) grasping manually said strap retainer device and the strap;

(d) looping the strap around the first object;

(e) inserting the strap into said second end tortuous access passageway adjacent to said outer periphery portion;

(f) continuing to feed the strap through said second end tortuous passageway deforming the strap laterally to negotiate said second end first acute angle and said oppositely disposed second end second acute angle until said second end slot is reached;

(g) pushing the strap into said second end slot and continuing to push the strap into said second end angled portion extension until the strap clears said second end tortuous passageway; and (h) centering the strap in said second end slot by reversibly pushing the strap out of said second end angled portion extension until the strap is adjacent to said second end slot closed distal end, wherein said strap retainer device substantially retains the strap in said second end slot irrespective of the relevant positions of the first object and the second object.

5. A method of selectively retaining a first object to a second object according to claim 4 wherein said step (g) involves pushing the strap into said second end angled portion extension until a strap lengthwise edge is adjacent to said second end tortuous passageway and said step (f) involves feeding the strap through said second end tortuous passageway deforming the strap laterally to negotiate said second end second acute angle and said oppositely disposed second end first acute angle until the strap reaches said outer periphery portion, wherein the strap can be removed from said strap retainer device thus selectively unretaining the first object from the second object.

* * * * *